US011504578B2

(12) United States Patent
Sasano

(10) Patent No.: US 11,504,578 B2
(45) Date of Patent: Nov. 22, 2022

(54) COLLAPSIBLE PUSHUP BAR

(71) Applicant: Remy Sasano, Osaka (JP)

(72) Inventor: Remy Sasano, Osaka (JP)

(73) Assignee: Kensui LLC, Sheridan, WY (US)

( * ) Notice: Subject to any disclaimer, the term of this patent is extended or adjusted under 35 U.S.C. 154(b) by 84 days.

(21) Appl. No.: 16/842,827

(22) Filed: Apr. 8, 2020

(65) Prior Publication Data

US 2020/0324165 A1 Oct. 15, 2020

Related U.S. Application Data

(60) Provisional application No. 62/831,270, filed on Apr. 9, 2019.

(51) Int. Cl.
*A63B 23/12* (2006.01)
*A63B 21/00* (2006.01)

(52) U.S. Cl.
CPC .... *A63B 23/1236* (2013.01); *A63B 21/00047* (2013.01); *A63B 2210/50* (2013.01)

(58) Field of Classification Search
CPC ..... A63B 23/1227; A63B 23/1236; A63B 1/00–04; A63B 3/00; A63K 3/043
See application file for complete search history.

(56) References Cited

U.S. PATENT DOCUMENTS 4,351,525 A * 9/1982 Rozenblad ..... A63B 23/12 482/141
6,063,005 A * 5/2000 Schwartz ..... A63K 3/043 482/16
7,270,628 B2 9/2007 Campanaro et al.
D580,998 S * 11/2008 Lin ..... D21/691
7,468,025 B2 * 12/2008 Hauser ..... A63B 23/1281 482/141
7,553,267 B1 * 6/2009 Hauser ..... A63B 21/4049 482/141
8,460,160 B2 * 6/2013 Andrews ..... A63B 21/4019 482/44
9,308,416 B1 * 4/2016 Oliverlo ..... A63B 23/1236
9,427,611 B1 * 8/2016 Balentine ..... A63B 21/068
9,675,829 B1 * 6/2017 Katz ..... A63B 17/02
9,717,948 B1 * 8/2017 Hsu ..... A63B 23/1227
9,808,665 B1 * 11/2017 Demarais ..... A63B 21/4035
9,868,006 B1 * 1/2018 Epler ..... A63B 21/068
10,357,675 B1 * 7/2019 Katz ..... A63B 21/00047
10,777,092 B2 * 9/2020 Mudarra ..... A63B 71/028
2005/0101461 A1 * 5/2005 Johnson ..... A63B 21/0004 482/141
2005/0130806 A1 * 6/2005 Lopez ..... A63B 21/00047 482/38

(Continued)

*Primary Examiner* — Nyca T Nguyen
(74) *Attorney, Agent, or Firm* — Ashok Tankha

(57) ABSTRACT

A collapsible push-up bar comprises a hollow main shaft and a leg assembly. The collapsible push-up bar is, for example, a pair of push up bars which are modular and portable. The collapsible push-up bar is used for exercising, gymnastics and calisthenics. The hollow main shaft comprises one or more engagement devices that are disposed on a length of the hollow main shaft. The hollow main shaft is configured to be held by a user during a workout. The leg assembly comprises one or more support legs, insertable within the hollow main shaft and configured to be removably secured to the engagement device within the hollow main shaft.

8 Claims, 37 Drawing Sheets

(56) References Cited

U.S. PATENT DOCUMENTS

| | | | | |
|---|---|---|---|---|
| 2005/0187083 | A1* | 8/2005 | Krystoff | A63B 21/00047 482/96 |
| 2005/0209054 | A1* | 9/2005 | Thomas Lebert | A63B 21/4035 482/41 |
| 2007/0010375 | A1* | 1/2007 | Corte | A63B 1/00 482/41 |
| 2010/0120586 | A1* | 5/2010 | Ruschell | A63B 71/0054 482/148 |
| 2010/0317496 | A1* | 12/2010 | Abranchess | A63B 23/12 482/141 |
| 2012/0040811 | A1* | 2/2012 | DeTore | A63B 23/1236 482/141 |
| 2012/0316043 | A1* | 12/2012 | Mangalindan | A63B 23/1236 482/141 |
| 2013/0072365 | A1* | 3/2013 | Ross | A63B 23/1218 482/141 |
| 2014/0066274 | A1* | 3/2014 | Kassel | A63B 23/1236 482/141 |
| 2014/0371040 | A1* | 12/2014 | Vasquez | A63B 21/0004 482/39 |
| 2015/0367170 | A1* | 12/2015 | Robertson | A63B 22/20 482/139 |
| 2016/0074693 | A1* | 3/2016 | Henry | A63B 21/4033 482/141 |
| 2017/0120099 | A1* | 5/2017 | Biddix, Jr. | A63B 23/1218 |
| 2017/0189739 | A1* | 7/2017 | Ressler, III | A63B 21/00181 |
| 2020/0368576 | A1* | 11/2020 | McKee | A63B 21/4034 |
| 2021/0178216 | A1* | 6/2021 | Ducato | A63B 23/1236 |
| 2021/0178217 | A1* | 6/2021 | Ix | A63B 21/4035 |
| 2021/0394019 | A1* | 12/2021 | Stevenson, III | A63B 23/1236 |
| 2022/0040523 | A1* | 2/2022 | Smith | A63B 23/1236 |

* cited by examiner

COLLAPSIBLE PUSHUP BAR

CROSS-REFERENCE TO RELATED APPLICATIONS

This application claims priority to and the benefit of the provisional patent application titled "Nanobars", application No. 62/831,270, filed in the United States Patent and Trademark Office on Apr. 9, 2019. The specification of the above referenced patent application is incorporated herein by reference in its entirety.

BACKGROUND

The busy lifestyle of persons does not permit users to regularly go out and exercise at gymnasiums and other health clubs. This creates a demand for portable fitness equipment that allow users to exercise at locations other than a gymnasium, for example at their residence, in their office, etc. Many types of portable fitness equipment is available in the market, for example, jump ropes, resistance bands, suspension trainers, exercise ball, etc. Push-ups are a common exercise that persons engage in both for exercises and also for gymnastics and calisthenics. Push-ups are optionally performed on equipment provided with a handle to facilitate the push-up. To meet this requirement, push-up bars are available in the market in single bar form, and with disconnect features. The push-up bars are available in the market either in a curved or straight bar design.

Push-up bars, also called parallettes, that are available in the market are bulky, not portable, and do not allow the push-up bar to be collapsed and the disassembled parts to be compactly stored, for example, within a main bar of the push-up bar. Hence, there is a long felt but unresolved need for a portable push-up bar that allows the components of the push-up bar to be disassembled and collapsed into a compact format, to allow the push-up bar to be readily transported, assembled and used at another location.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The collapsible push-up bar disclosed herein comprises a hollow main shaft and a leg assembly. The collapsible push-up bar is for example, one of a pair of push up bars, also called parallettes, that are used for exercising, gymnastics and calisthenics. The collapsible push-up bar is modular and portable. The hollow main shaft comprises one or more engagement devices disposed on a length of the hollow main shaft. The hollow main shaft is configured to be held by a user during a workout, for example, a push-up. The leg assembly comprises one or more support legs configured to be removably secured to the engagement device of the hollow main shaft. The leg assembly is configured to be disassembled and accommodated within the hollow main shaft. The collapsible push-up bar comprises removable non-skid legs that can be stored inside the hollowed-out shaft of the push-up bar.

In an embodiment, the collapsible push-up bar further comprises a first end-cap and a second end-cap, wherein the first and second end-caps are configured to close distal ends of the hollow main shaft. The leg assembly can be disassembled and inserted into the hollow main shaft and thereafter secured within hollow main shaft by closing the distal ends of the hollow main shaft with the first and second end-cap. Upon closing, the first end-cap and the second end-cap preclude the support legs from falling out of the hollow main shaft through the distal ends, for example, during transport of the collapsible push-up bar. In another embodiment, each of the first and second end-caps is hollowed out to allow any overhanging portion of the leg assembly to project into the hollowed out portion of the first and second end-caps. In an embodiment, the hollow main shaft is elliptical in cross section. In another embodiment, the collapsible push-up bar comprises a hollow main shaft comprising an open proximal end and a closed distal end opposite to the open distal end. In this embodiment of the collapsible push-up bar, a single end-cap is used to close the open proximal end of the hollow main shaft. In an embodiment, each engagement device is a threaded hole configured to receive and removably secure each of the one or more support legs. In an embodiment, each engagement device is a receptacle configured to receive a button type snap fit fastener that is disposed at a distal end of one or more support legs.

In an embodiment, each engagement device is a snap fit receiver that is one of a female receiver and a male receiver for receiving and removably securing one or more support legs that comprise an opposing one of the female receiver and a male receiver. In an embodiment, the leg assembly comprises a vertical support bar and a horizontal support bar. One end of the vertical support bar is removably secured to the engagement device in the hollow main shaft, and an opposing end of the vertical support bar is configured to receive a horizontal support bar. The horizontal support bar is configured to be removably secured to the opposing end of the vertical support bar along a mid-section of the horizontal support bar, and the horizontal support bar is configured to rest on a ground surface.

In an embodiment, the vertical support bar and the horizontal support bar are hollow and are generally semicircular in cross section. In an embodiment, the engagement devices of the hollow main shaft are semicircular in form to receive the vertical support bar and the horizontal support bar.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

FIG. 1I illustrates slidably inserting vertical support bars and horizontal support bars into the hollow main shaft of the first embodiment of the collapsible push-up bar.

DETAILED DESCRIPTION OF THE INVENTION

Figure 1A:
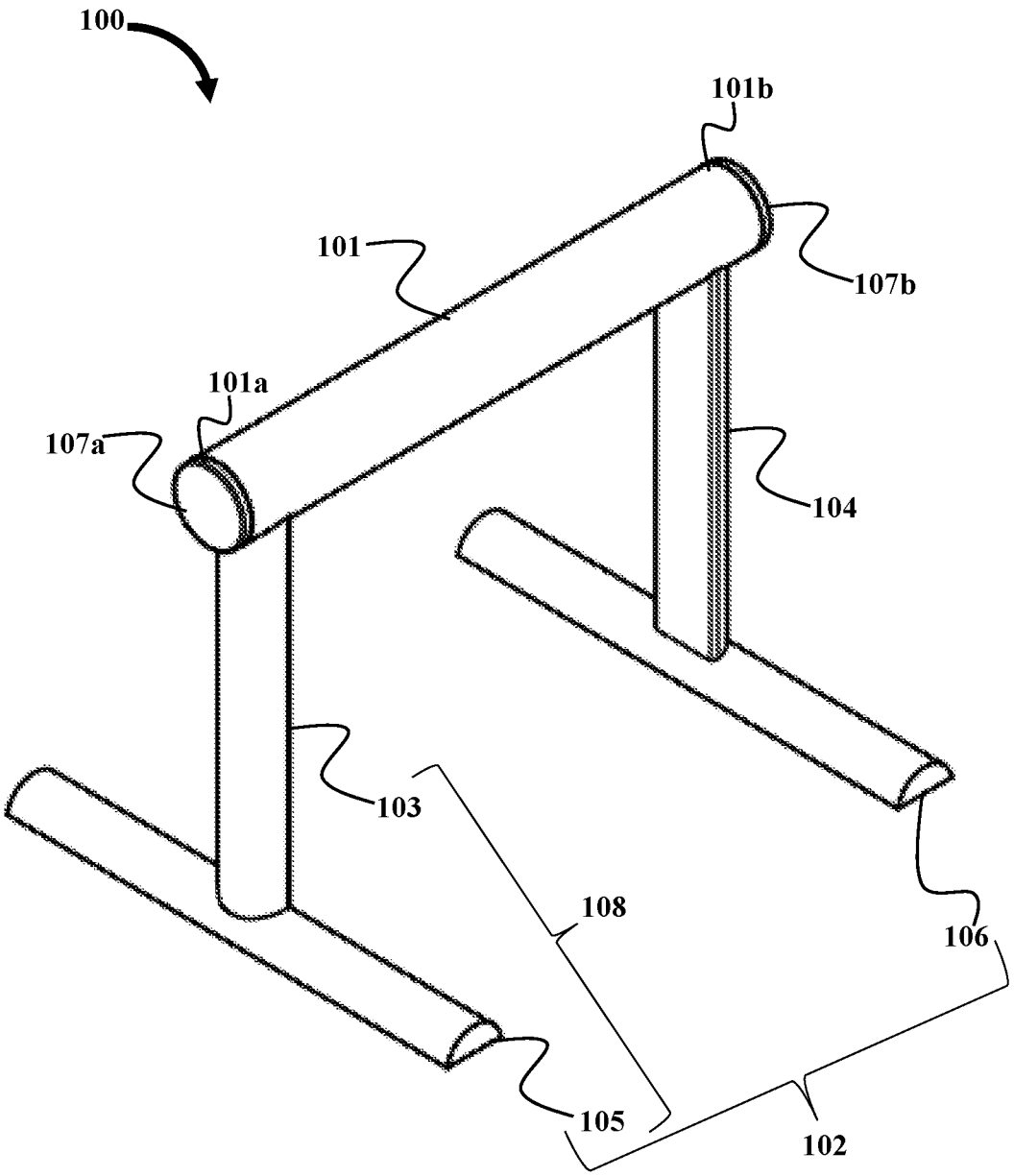
FIG. 1A exemplarily illustrates a top perspective view of a first embodiment of the collapsible push-up bar.
Figure 1B:
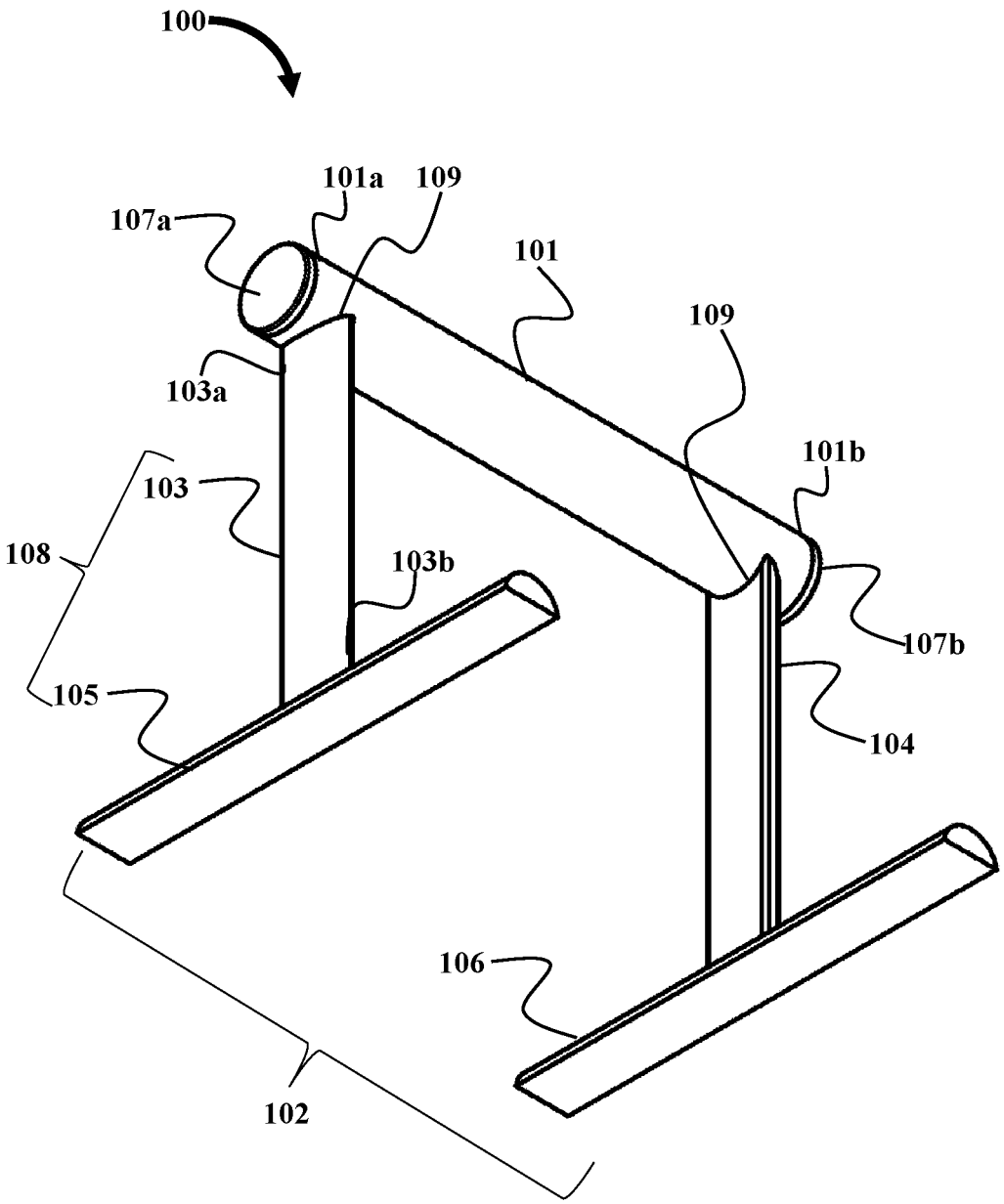
FIG. 1B exemplarily illustrates a bottom perspective view of the first embodiment of the collapsible push-up bar.

FIGS. 1A-1D exemplarily illustrates the first embodiment of the collapsible push-up bar 100. FIG. 1A exemplarily illustrates a top perspective view of a first embodiment of the collapsible push-up bar 100, FIG. 1B exemplarily illustrates a bottom perspective view of the first embodiment of the collapsible push-up bar 100, FIG. 1C exemplarily illustrates a top perspective view of a vertical support bar 103 of the first embodiment of the collapsible push-up bar 100, and FIG. 1D exemplarily illustrates a front perspective view of an end-cap 107*a* of the first embodiment of the collapsible push-up bar 100. The collapsible push-up bar 100 disclosed herein comprises a hollow main shaft 101 and a leg assembly 102. The hollow main shaft 101 comprises one or more engagement devices 109 disposed on a length of the hollow main shaft 101, as illustrated in FIG. 1B to removably secure the support legs 108 to the engagement device 109 in the hollow main shaft 101. The hollow main shaft 101 is configured to provide support to a user during a workout. As shown in FIG. 1A, the leg assembly 102 comprises one or more support legs 108 configured to be removably secured to the engagement devices 109 in the hollow main shaft 101. In this embodiment, the hollow main shaft 101 is disposed at an elevation above the ground. In this first embodiment, there is less stress on the legs of the user performing push-ups on the collapsible push-up bar 100. This embodiment also allows for removable storage of the leg assembly 102 within the hollow main shaft 101. The leg assembly 102 comprises the vertical support bars 103 and 104 and horizontal support bars 105 and 106.

In the first embodiment, each of the vertical support bars 103 and 104 of the support legs 108 is securely connected to the engagement device 109 of the hollow main shaft 101 prior to the user performing push-ups. Furthermore, the leg assembly 102 is insertable into the hollow main shaft 101, as illustrated in FIG. 1G, by aligning the vertical support bars 103 and 104 with the engagement devices 109 of the hollow main shaft 101 along the axis A-A' and axis B-B'. The first ends 103*a* and 104*a* of the aligned vertical support bars 103 and 104 are then inserted into the engagement devices 109, respectively. The horizontal support bars 105 and 106 are removably secured to the vertical support bars 103 and 104, respectively, as illustrated in FIG. 1G. Each of the horizontal support bars 105 and 106 comprise a receiver slot 105*a* and 106*a* in a mid-section of the horizontal support bars 105 and 106, as illustrated in FIGS. 1H and 1I, for receiving the vertical support bars 103 and 104. The receiver slots 105*a* and 106*a* of the horizontal support bars 105 and 106 are aligned with the second ends 103*b* and 104*b* of the vertical support bars 103 and 104 along the axis A-A' and axis B-B'. The vertical support bars 103 and 104 are then inserted into the receiver slots 105*a* and 106*a* of the aligned horizontal support bars 105 and 106. The leg assembly 102 is detachably attached to the hollow main shaft 101. In an embodiment, the collapsible push-up bar 100 further comprises a first end-cap 107*a* and a second end-cap 107*b*, wherein the first and second end-caps 107*a* and 107*b* are disposed and removably secured to proximal and distal ends 101*a* and 101*b* of the hollow main shaft 101 after the leg assembly 102 is inserted into the hollow main shaft 101. The first and second end-caps 107*a* and 107*b* are aligned with the distal ends 101*a* and 101*b* of the hollow main shaft 101 along the axis C-C', as illustrated in FIG. 1G. The hollow main shaft 101 is then closed by securing the first and second end-caps 107*a* and 107*b* to the proximal and distal ends 101*a* and 101*b*, respectively. In another embodiment, each end-cap 107*a* and 107*b* is hollowed out, as shown in FIG. 1F, to allow any projecting portion of the leg assembly 102 to project into the hollowed-out portion of the first 107*a* and second end-caps 107*b*.

In another embodiment, the collapsible push-up bar 100 comprises a hollow main shaft 101 comprising an open proximal end 101*a* and a closed distal end 101*b* opposite to the open proximal end 101*a*. In this embodiment of the collapsible push-up bar, a single end-cap 107*a* is used to close the open proximal end 101*a* of the hollow main shaft 101.

In an embodiment, the vertical support bars 103 and 104 and the horizontal support bars 105 and 106 of the first embodiment are also hollowed out. The hollowed out vertical support bars 103 and 104 are disposed within the hollowed out horizontal support bars 105 and 106, or vice versa. In an embodiment, only the vertical support bars 103 and 104 are hollowed out. The horizontal support bars 105 and 106 are slidably inserted into the hollowed out vertical support bars 103 and 104, as illustrated in FIG. 1H. In another embodiment, only the horizontal support bars 105 and 106 are hollowed out and the vertical support bars 103 and 104 are slidably inserted into the hollowed out horizontal support bars 105 and 106. The vertical support bars 103 and 104 and the horizontal support bars 105 and 106 are then slidably inserted into the hollow main shaft 101, as illustrated in FIG. 1I.

Figure 1C:
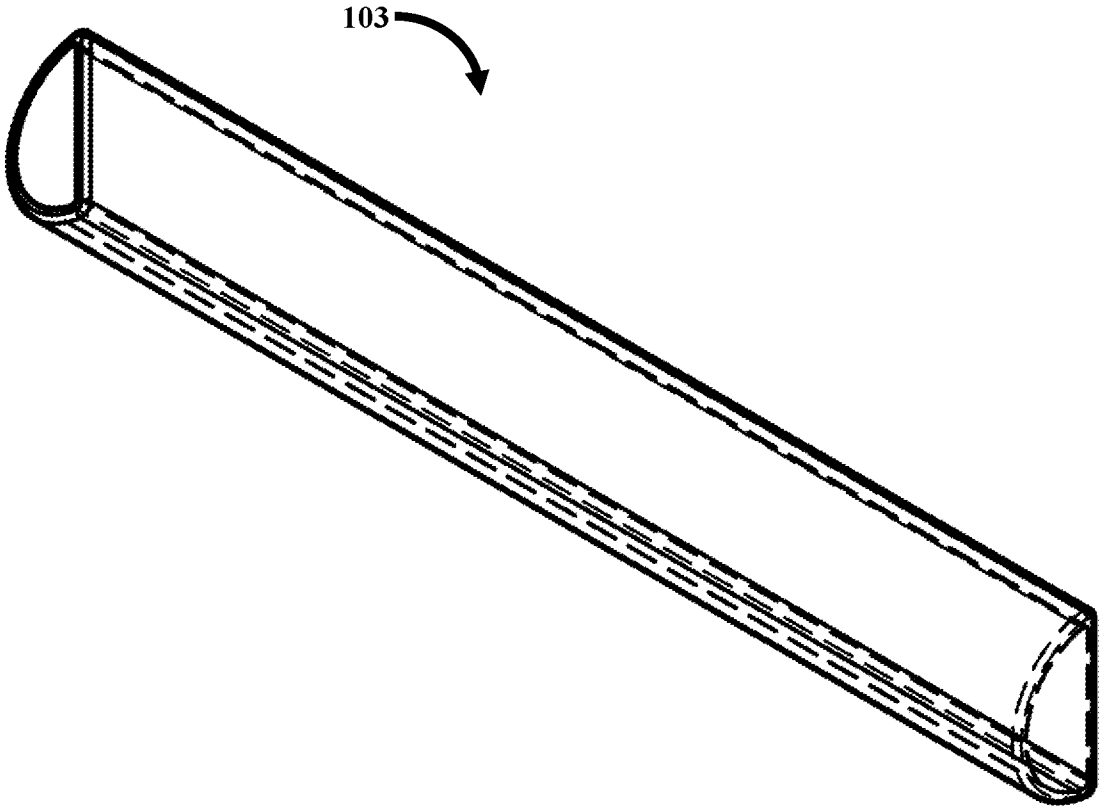
FIG. 1C exemplarily illustrates a top perspective view of a vertical support bar of the first embodiment of the collapsible push-up bar.
Figure 1D:
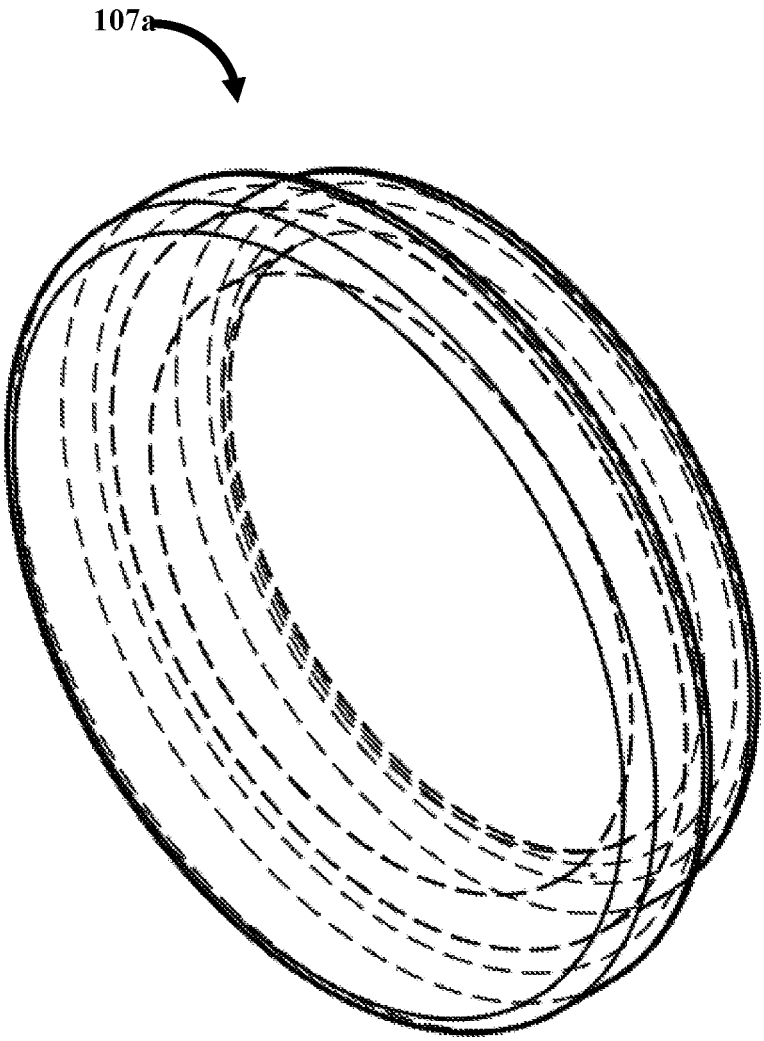
FIG. 1D exemplarily illustrates a front perspective view of an end-cap of the first embodiment of the collapsible push-up bar, wherein the dashed lines illustrate the contours of the end-cap.
Figure 1F:
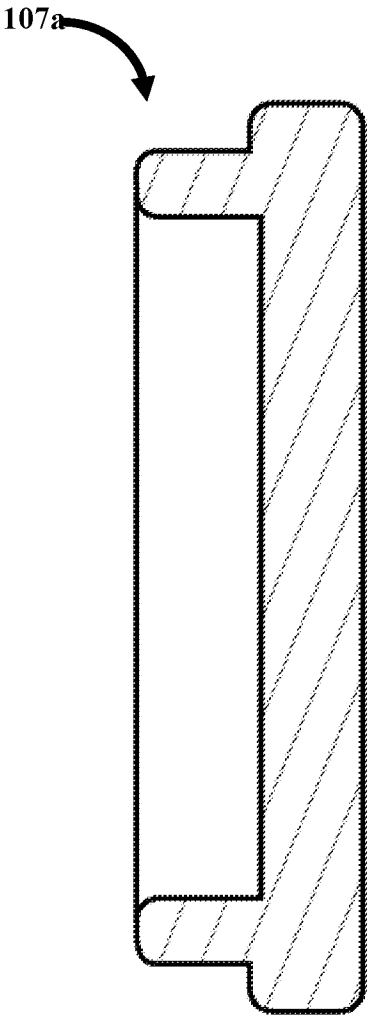
FIG. 1F illustrates a cross-sectional view of the end-cap of the first embodiment of the collapsible push-up bar.
Figure 1E:
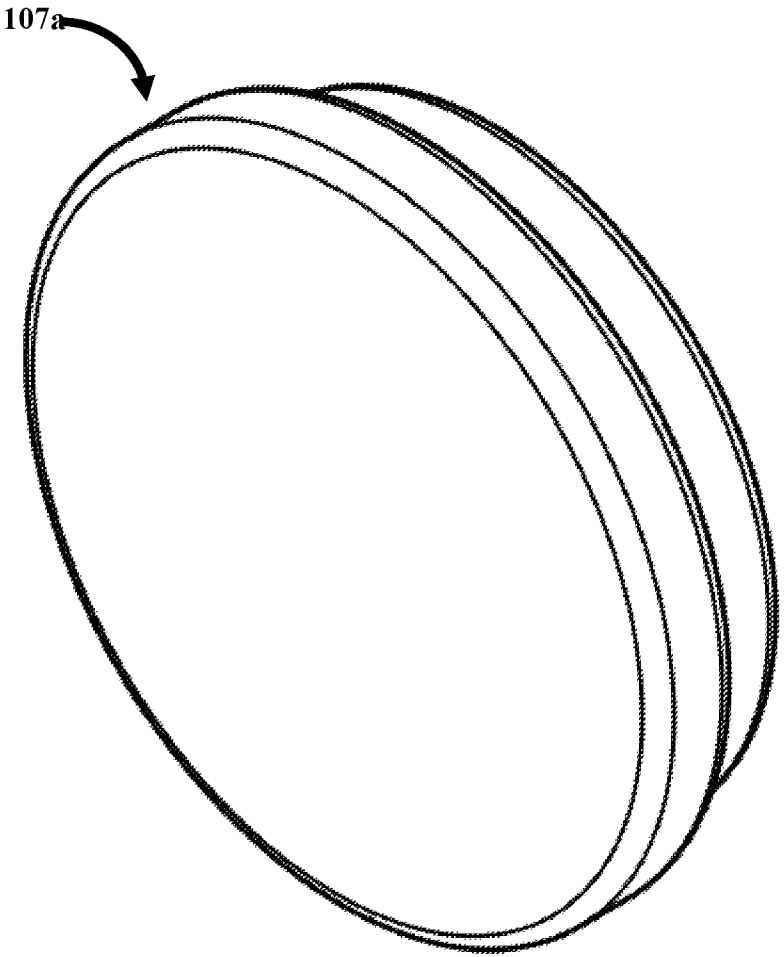
FIG. 1E exemplarily illustrates the front perspective view of the end-cap of the first embodiment of the collapsible push-up bar.
Figure 1G:
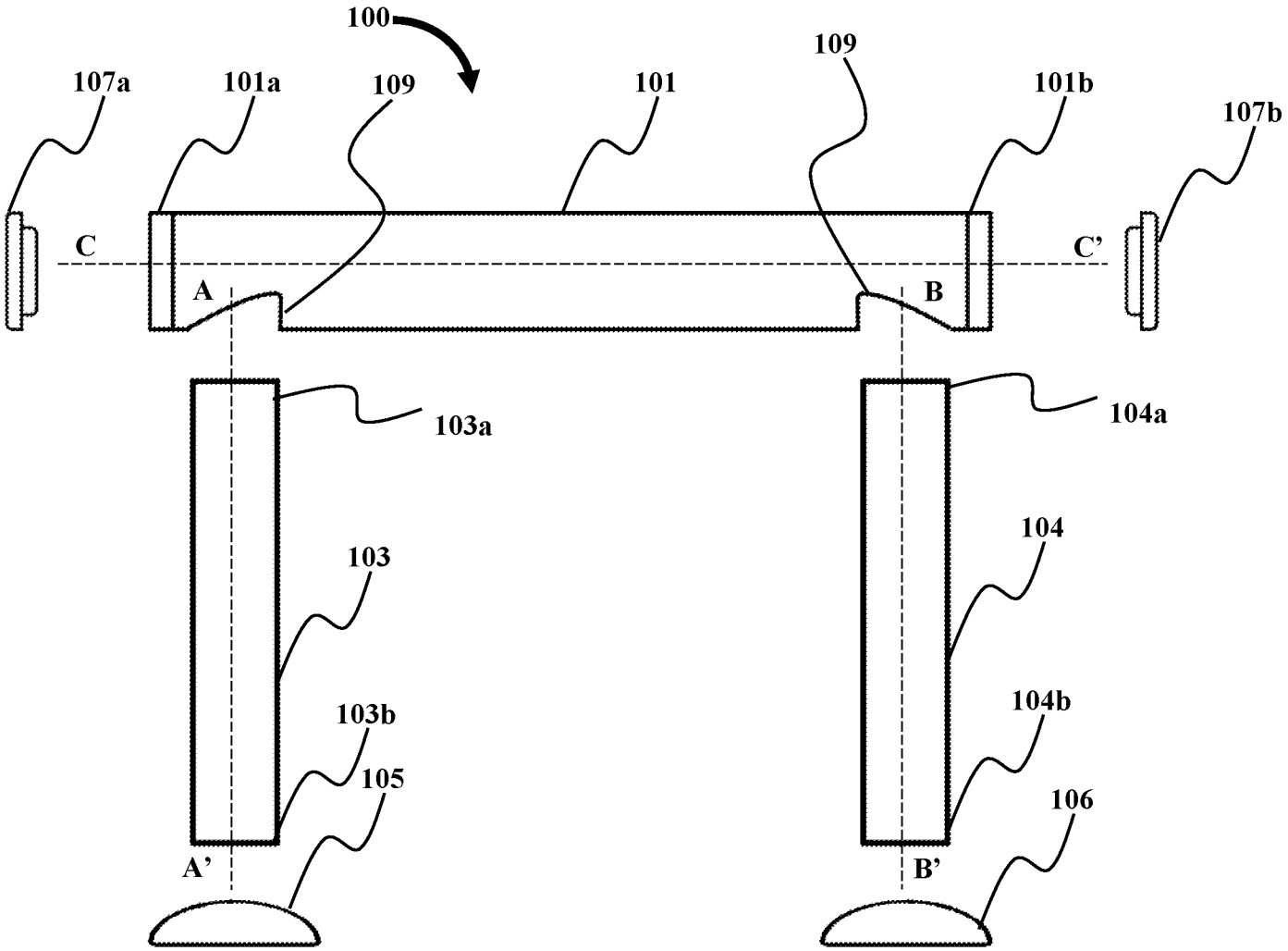
FIG. 1G illustrates a front exploded view of a vertical support bar of the first embodiment of the collapsible push-up bar.
Figure 1H:
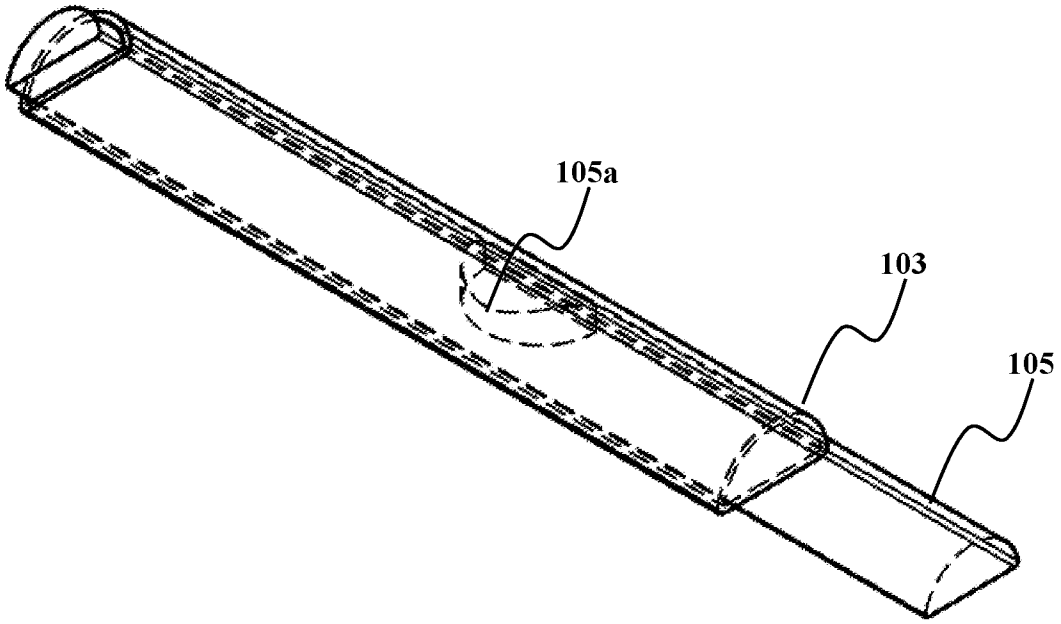
FIG. 1H illustrates slidably inserting a horizontal support bar of the first embodiment of the collapsible push-up bar into a hollowed out vertical support bar of the first embodiment of the collapsible push-up bar.
Figure 11:
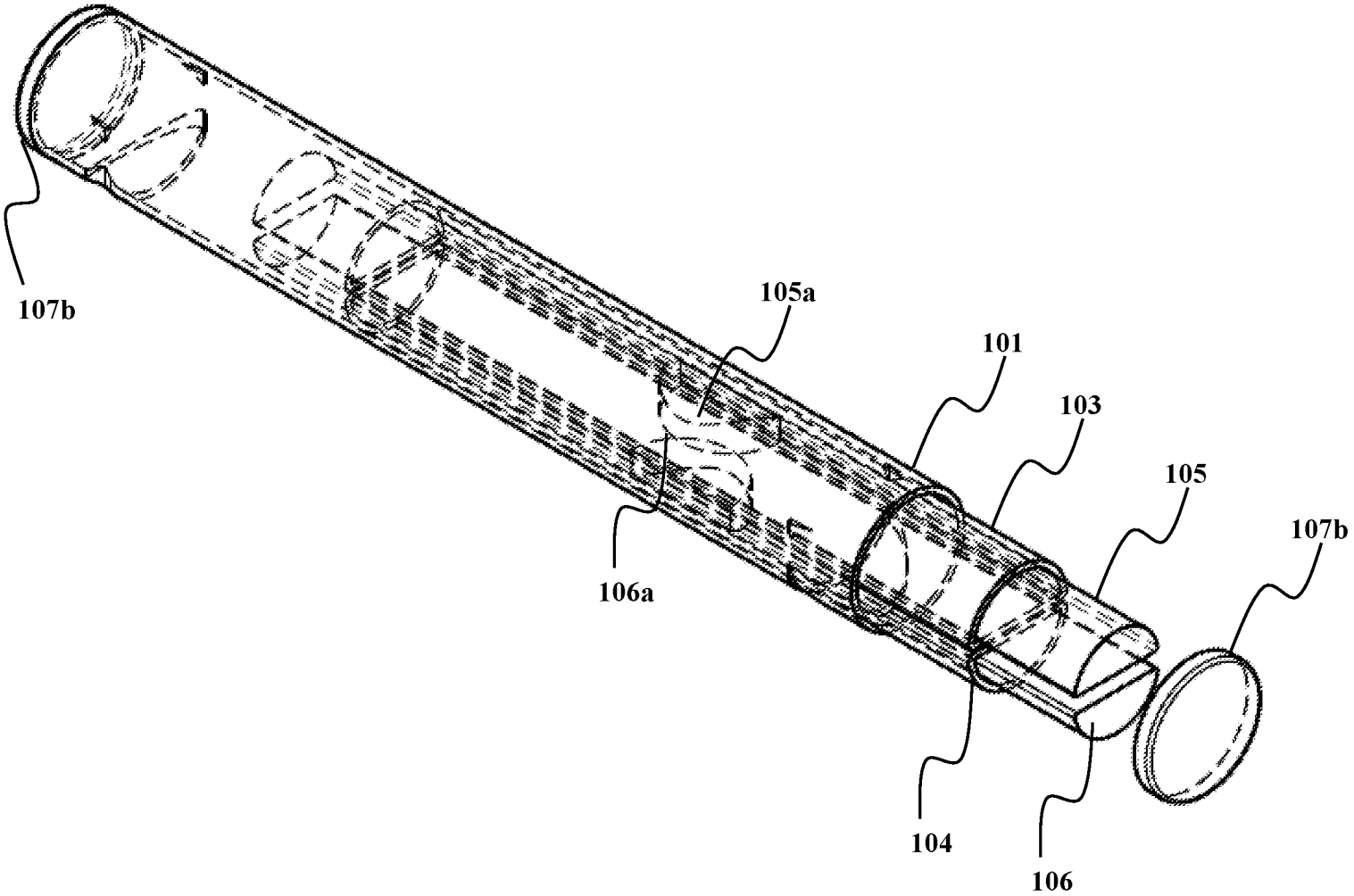

The vertical support bar 103, as shown in FIG. 1C, is semicircular in cross section and the end-cap 107*a* as shown in FIG. 1D is removably secured to the hollow main shaft 101 via a threadable connection, a snap fit connection, etc. In an embodiment, the horizontal support bars 105 and 106, and the vertical support bar 104 are also semicircular in cross section. As shown in FIGS. 1G and 2E, engagement devices 109 and 209 in the hollow main shaft 101 and 201 receive and removably connect with the vertical support bars 103 and 104. The engagement devices 109 and 209 are configured to conform to the cross-sectional shape of the vertical support bars 103 to provide a stable, free-standing leg support structure devoid of free play along a horizontal plane.

As shown in FIG. 1B, the horizontal support bar 105 is configured to be removably secured to the second end 103*b* of the vertical support bar 103 along a mid-section of the horizontal support bar 105, with the horizontal support bar 105 resting on the ground. The diameter of the hollow main shaft 101 is, for example, about 40 mm which is comparable to the diameter of parallel bars used in gymnastics. However, embodiments of the hollow main shaft 101 have different diameters for cylindrical as well as elliptical cross sections. In an embodiment, the push-up bar 100 is about 75 mm to about 250 mm in height, the vertical support bars 103 and 104 are about 55 mm to about 229 mm in height, and the horizontal support bars 105 and 106 are about 100 mm to about 230 mm in length. In an embodiment, the horizontal support bars 105 and 106 and the hollow main shaft 101 are of the same length. In another embodiment, the length of the horizontal support bars 105 and 106 is shorter than the hollow main shaft 101. In another embodiment, the height of the push-up bar 100 is about 100 mm which is the height of the handles on a pommel horse used in gymnastics. In an embodiment, the length of the vertical support bars 103 and 104 is about $3/4^{th}$ the length of the horizontal support bars 105 and 106.

Figure 1J:
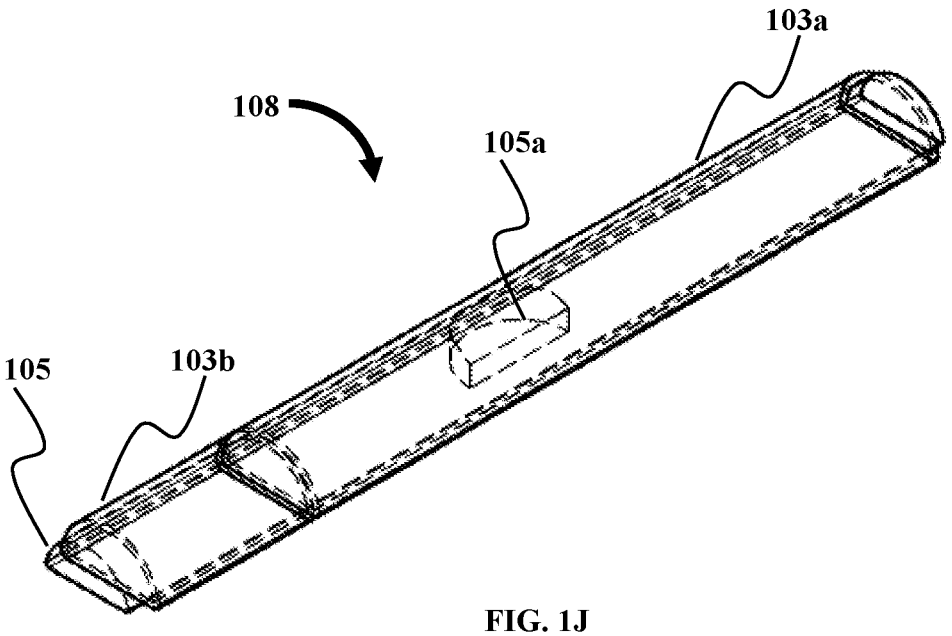
FIGS. 1J and 1K exemplarily illustrate an alternative embodiment of the support legs of the first embodiment of the collapsible push-up bar.
Figure 1K:
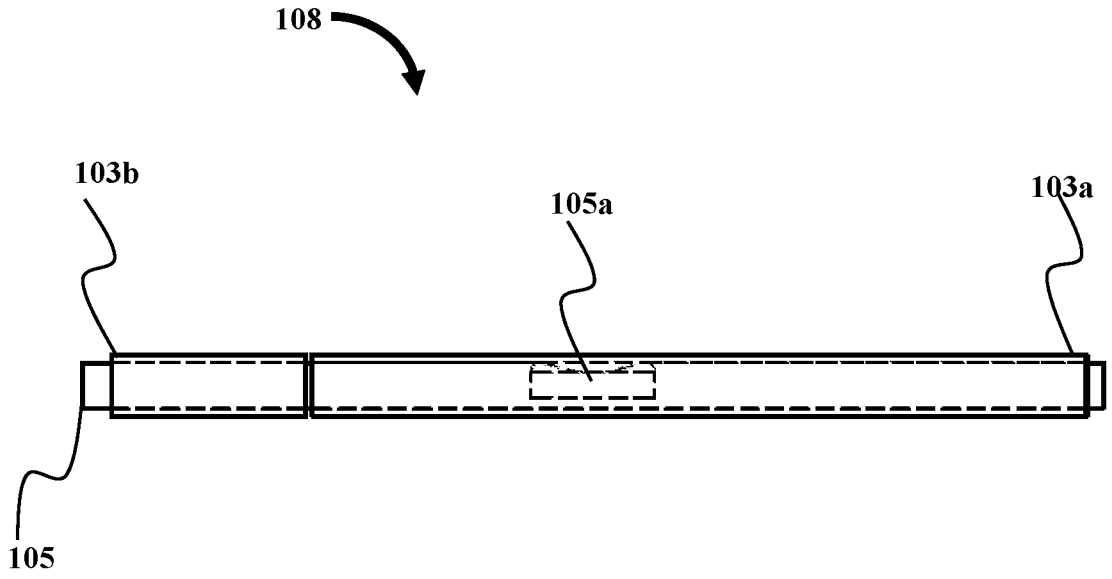

FIGS. 1J and 1K exemplarily illustrate an alternative embodiment of the support legs 108. Each of the support legs 108 comprises vertical support bars 103*a* and 103*b* of varying lengths. One of the vertical support bars 103*a* is of a longer length compared to the other vertical support bar 103*b*. In an embodiment, the total length of the vertical support bars 103*a* and 103*b* is equal to the length of the horizontal support bar 105. As illustrated in FIGS. 1J and 1K, both the vertical support bars 103*a* and 103*b* are hollowed out. The horizontal support bar 105 is slidably inserted into the hollowed out vertical support bars 103*a* and 103*b* such that the vertical support bars 103*a* and 103*b* are disposed adjacent to each other on the horizontal support bar 105.

Figure 2A:
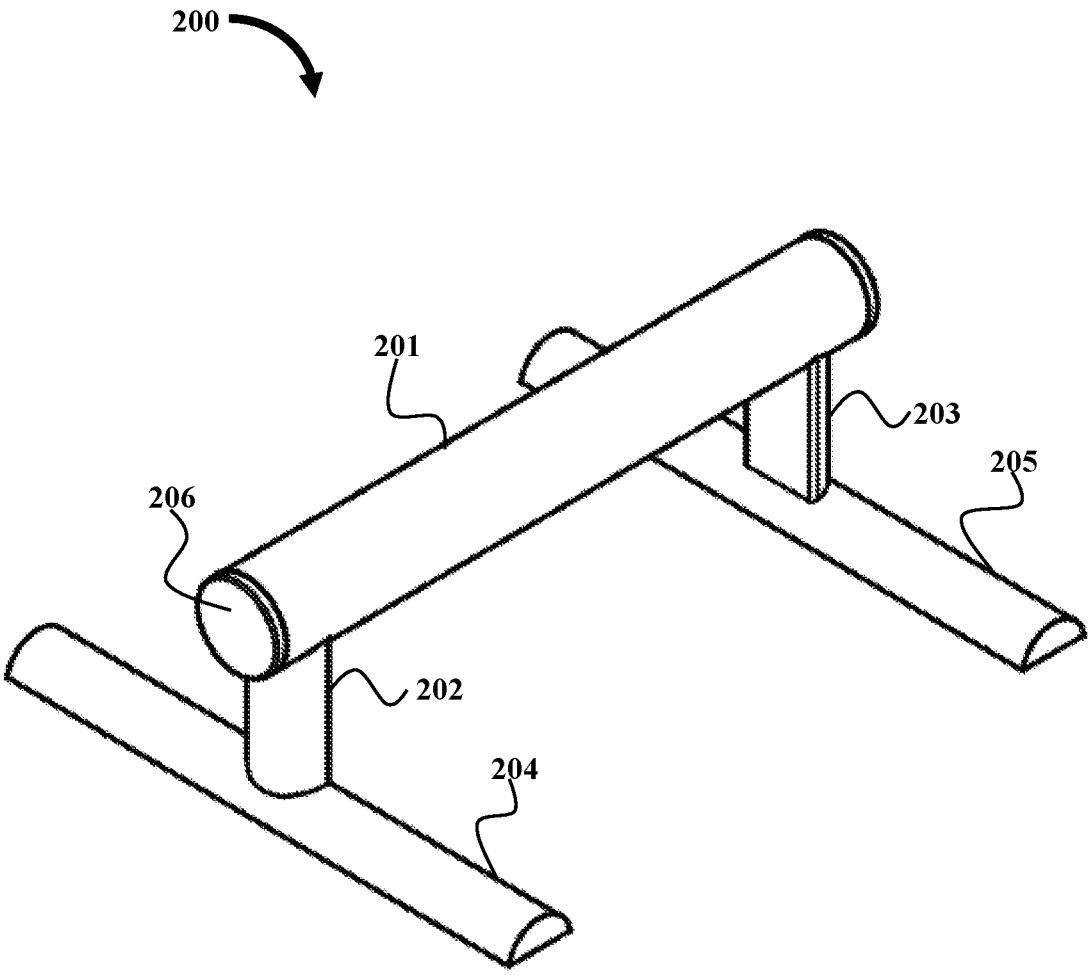
FIG. 2A exemplarily illustrates a top perspective view of a second embodiment of the collapsible push-up bar.
Figure 2B:
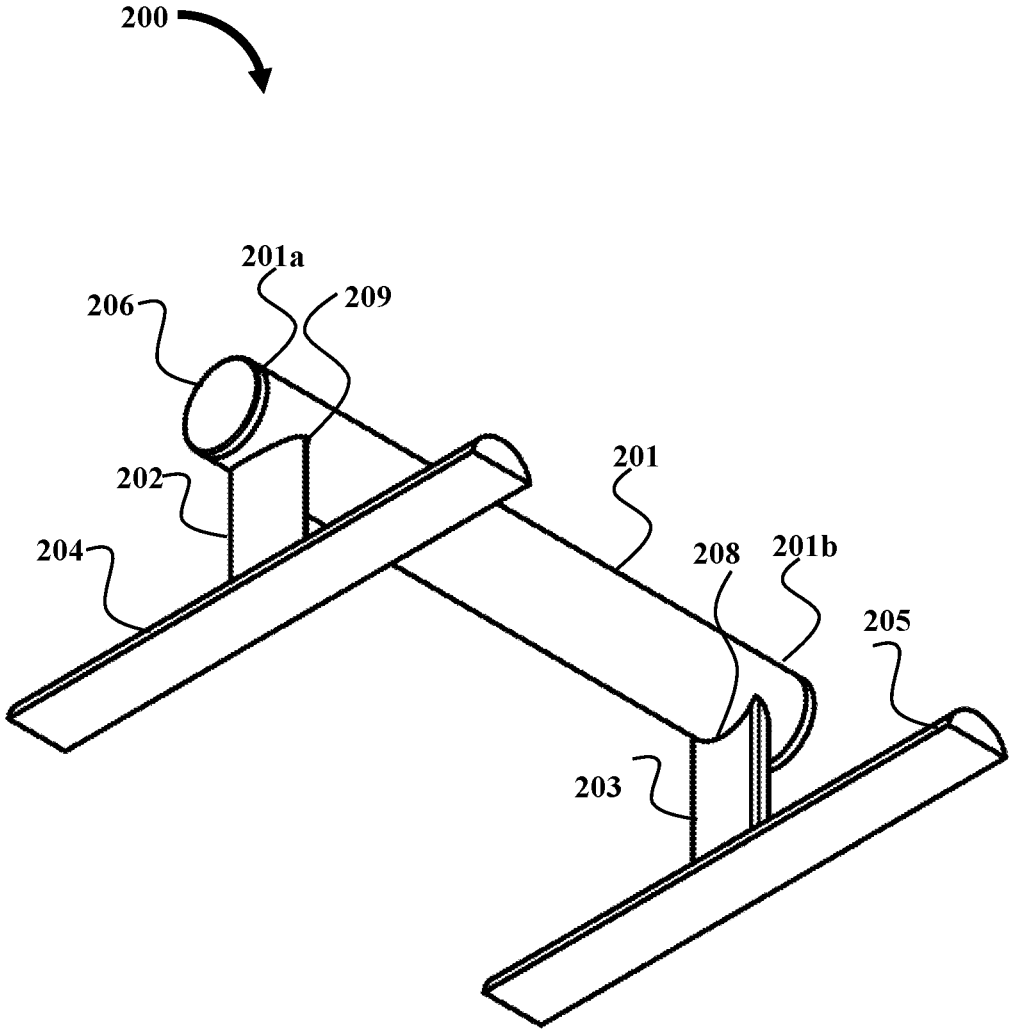
FIG. 2B exemplarily illustrates a bottom perspective view of the second embodiment of the collapsible push-up bar.
Figure 2C:
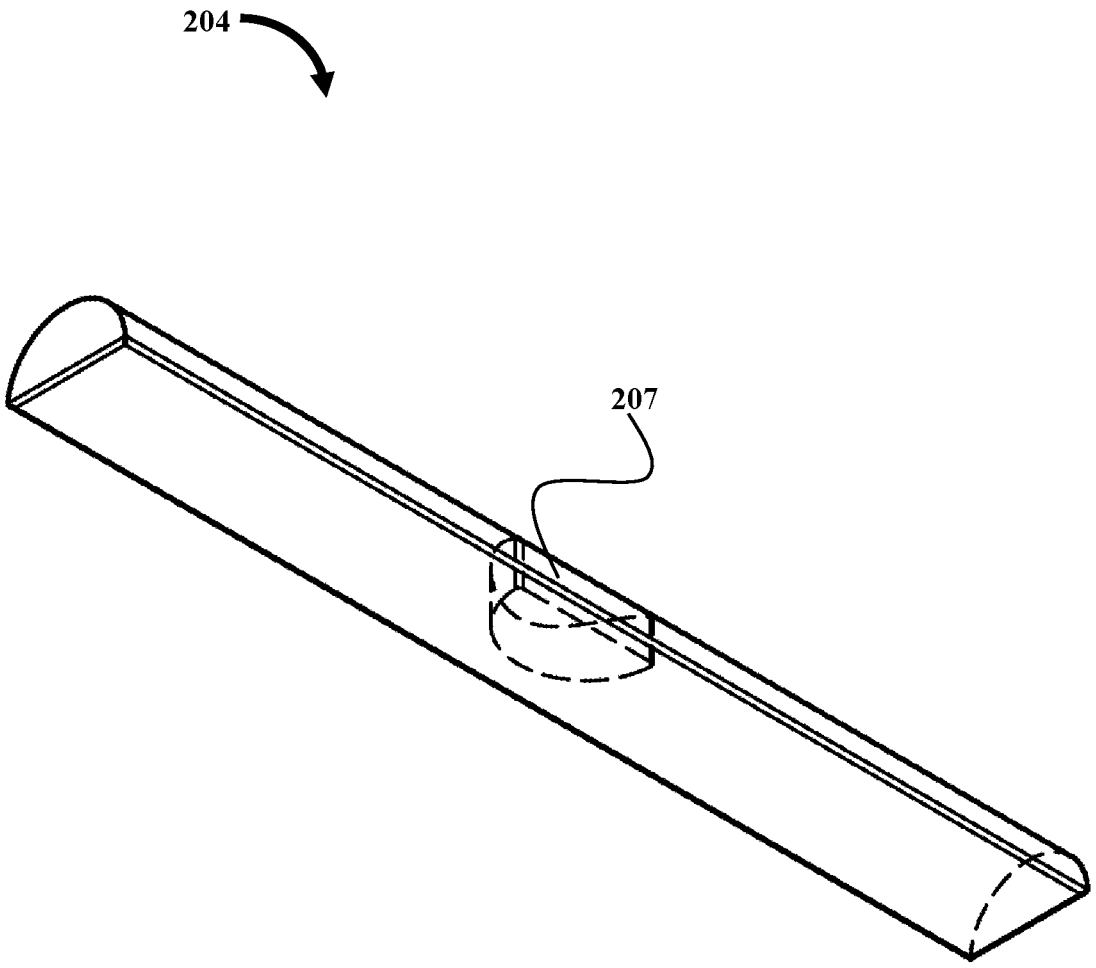
FIG. 2C exemplarily illustrates a bottom perspective view of a horizontal support bar of the second embodiment of the collapsible push-up bar.
Figure 2D:
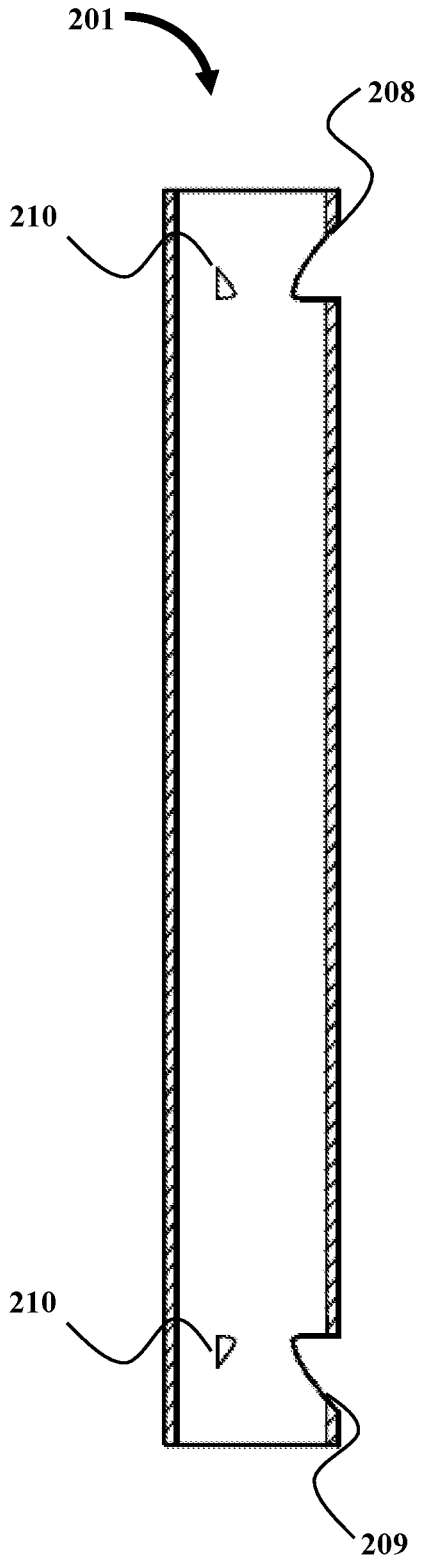
FIG. 2D exemplarily illustrates a cross-sectional view of a hollow main shaft of the second embodiment of the collapsible push-up bar.
Figure 2E:
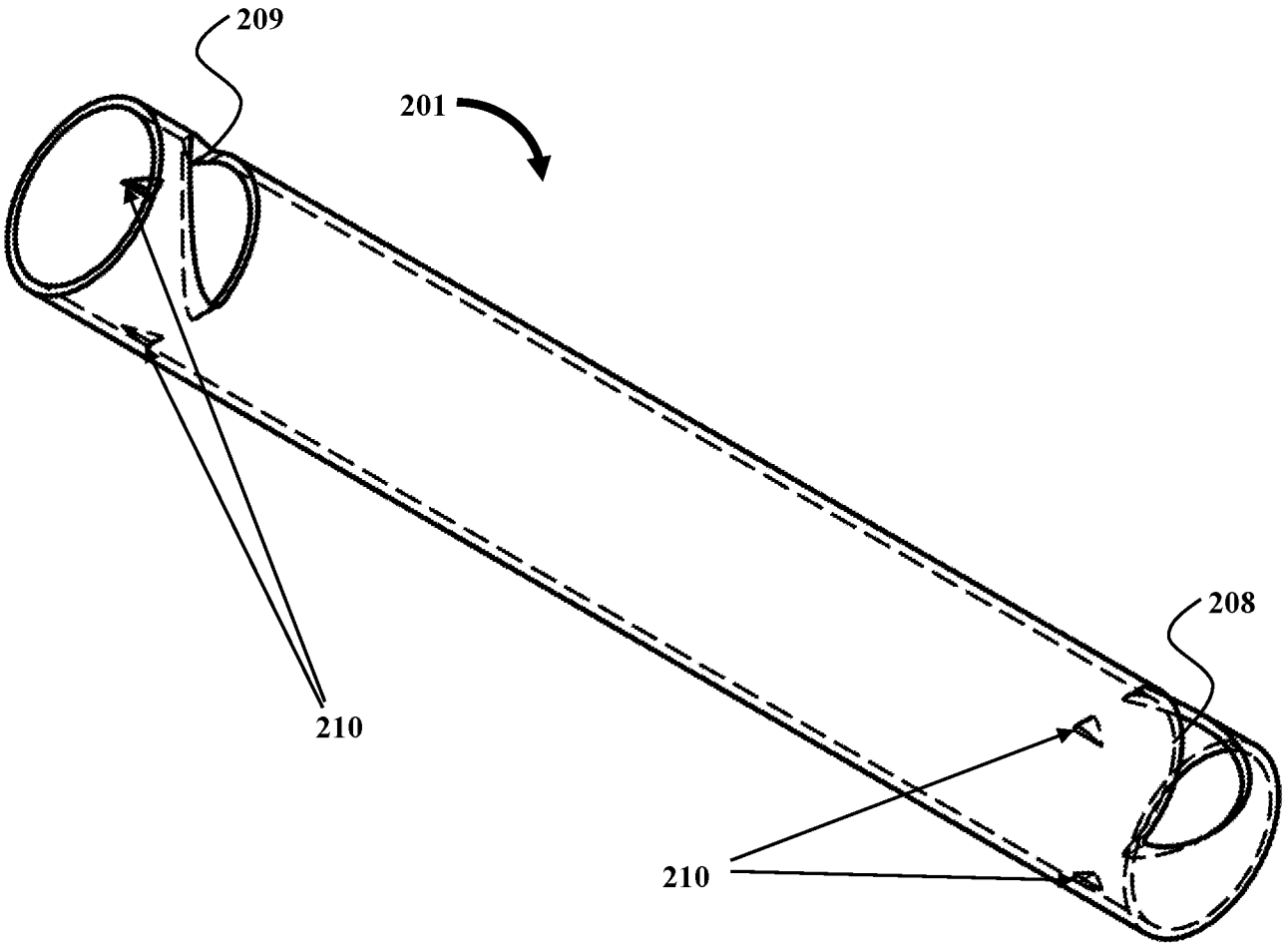
FIG. 2E exemplarily illustrates a front perspective view of the hollow main shaft of the second embodiment of the collapsible push-up bar.
Figure 2F:
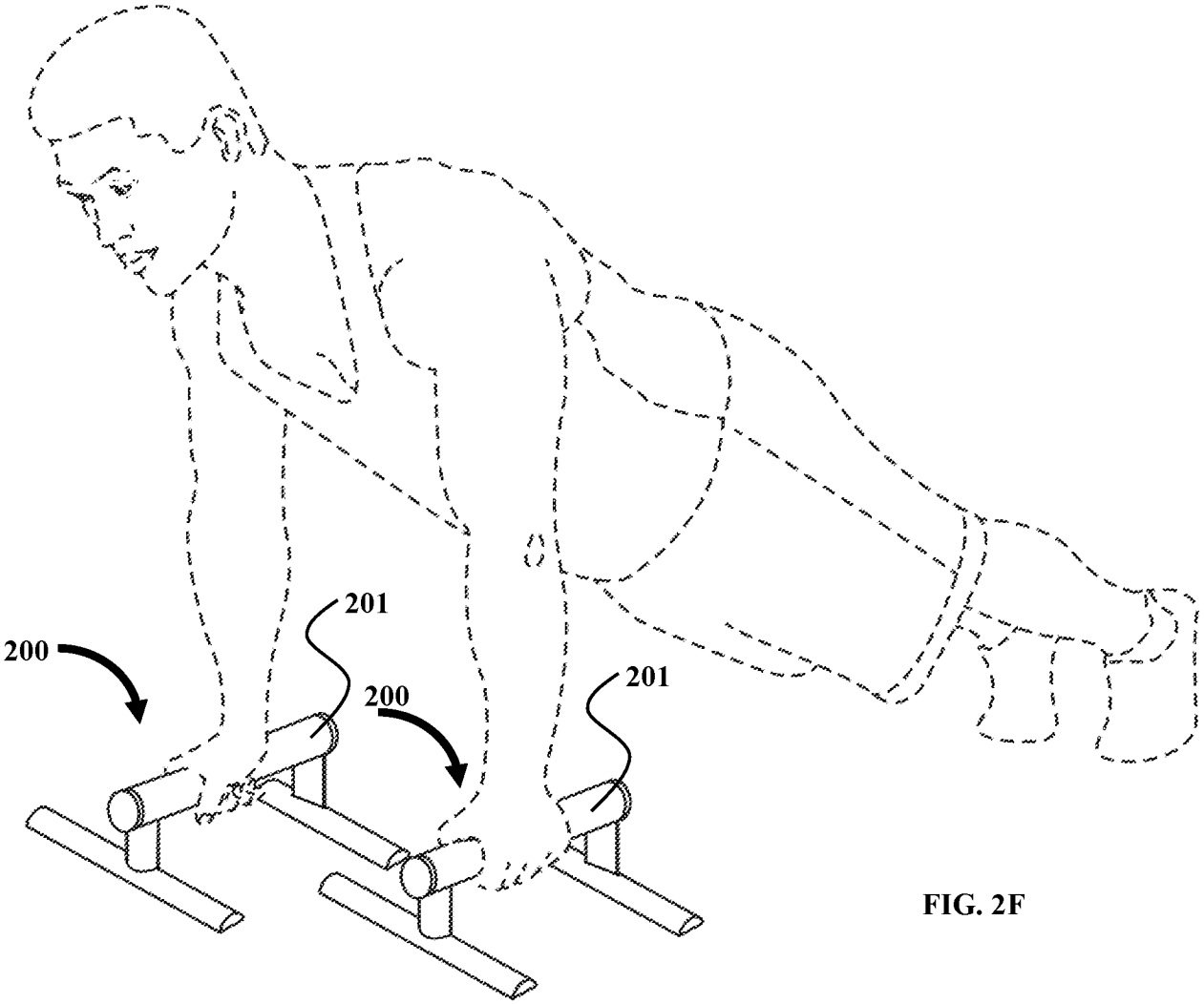
FIG. 2F exemplarily illustrates a user performing a push-up exercise using a pair of collapsible push-up bars of the second embodiment.

FIGS. 2A-2F exemplarily illustrates the second embodiment of the collapsible push-up bar 200. FIG. 2A exemplarily illustrates a top perspective view of a second embodiment of the collapsible push-up bar 200, FIG. 2B exemplarily illustrates a bottom perspective view of the second embodiment of the collapsible push-up bar 200, FIG. 2C exemplarily illustrates a bottom perspective view of a horizontal support bar 204 of the second embodiment of the collapsible push-up bar 200, and FIG. 2E exemplarily illustrates a front perspective view of a hollow main shaft 201 of the second embodiment of the collapsible push-up bar 200. The hollow main shaft 201 is configured to be held by a user during a workout, as illustrated in FIG. 2F. FIG. 2D exemplarily illustrates a cross-sectional view of a hollow main shaft 201 of the second embodiment of the collapsible push-up bar 200.

The structure of the second embodiment of the collapsible push-up bar 200 is similar to the first embodiment, except that the vertical support bars 202 and 203 are shorter than the vertical support bars 103 and 104 of the first embodiment of the collapsible push-up bar 100. The horizontal support bars 204 or 205 with semicircular cross section, shown in FIG. 2C, comprises a receiver slot 207 that is configured to receive and connect with the vertical support bar 202. The slot 207 is configured to conform to the cross-sectional shape of the vertical support bar 202. The vertical support bar 202 is inserted into the slot 207, to provide a stable, free-standing leg support structure devoid of free play along a horizontal plane. In an embodiment, the receiver slot 207 is located in a mid-section of the horizontal support bars 204 or 203. The hollow main shaft 201 as shown in FIG. 2E, comprises engagement devices 208 and 209 that are used to receive and removably connect with the vertical support bars 202 and 203. In an embodiment, the hollow main shaft 201 comprises an open proximal end 201*a* and a closed distal end 201*b* opposite to the open proximal end 201*a*, as shown in FIG. 2B. A single end-cap 206 is disposed and removably secured to the open proximal end 201*a* of the hollow main shaft 201.

In an embodiment, the hollow main shaft 201 comprises notches 210 on the inner wall of the hollow main shaft 201, as shown in FIGS. 2D and 2E. A pair of notches 210 proximal to the engagement device 208 secures the vertical support bar 203 to the hollow main shaft 201. Similarly, a pair of notches 210 proximal to the engagement device 209 secures the vertical support bar 202 to the hollow main shaft 201. The vertical support bars 202 and 203 are inserted into the engagement devices 208 and 209. The pair of notches allow the vertical support bars 202 and 203 to press-fit in the hollow main shaft 201 to preclude the vertical support bars 202 and 203 from moving with respect to the horizontal support bars 204 or 203.

Figure 3A:
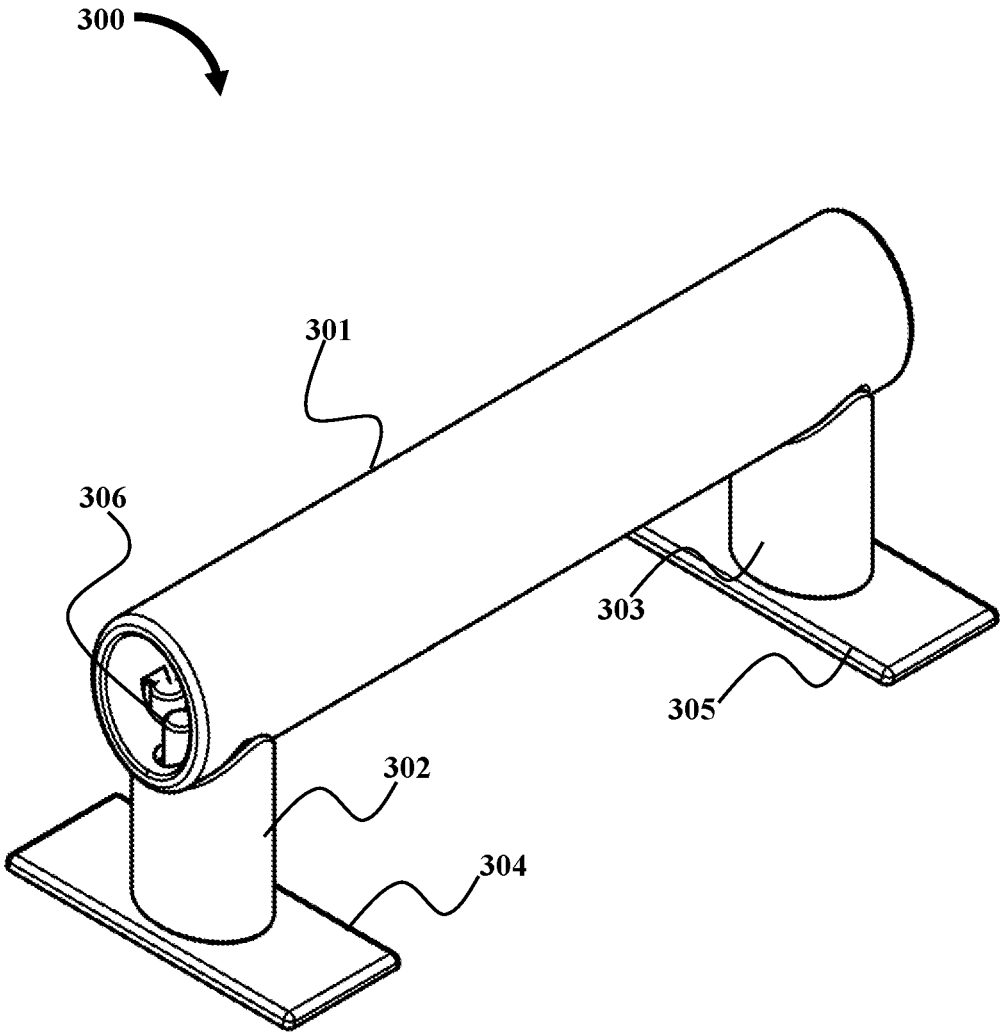
FIG. 3A exemplarily illustrates a top perspective view of a third embodiment of the collapsible push-up bar.
Figure 3B:
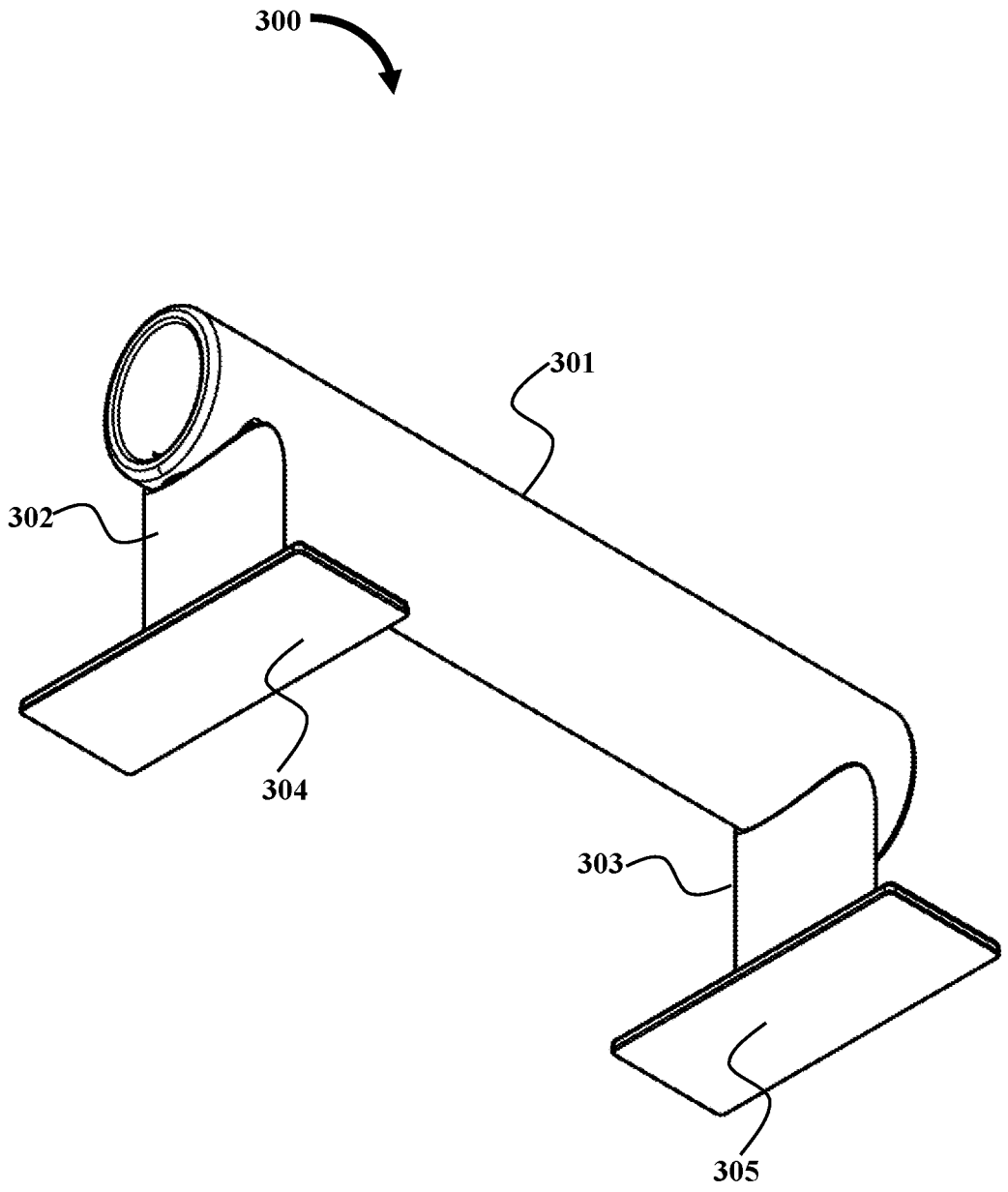
FIG. 3B exemplarily illustrates a bottom perspective view of the third embodiment of the collapsible push-up bar.

FIGS. 3A-3F exemplarily illustrates a third embodiment of the collapsible push-up bar 300. FIG. 3A exemplarily illustrates a top perspective view of a third embodiment of the collapsible push-up bar 300, FIG. 3B exemplarily illustrates a bottom perspective view of the third embodiment of the collapsible push-up bar 300, FIG. 3C exemplarily illustrates an exploded view of the third embodiment of the collapsible push-up bar 300, FIG. 3D exemplarily illustrates a bottom perspective view of a vertical support bar 302 of the third embodiment of the collapsible push-up bar 300, FIG. 3E exemplarily illustrates a top perspective view of a horizontal support bar 304 of the third embodiment of the collapsible push-up bar 300, and FIG. 3F exemplarily illustrates a top perspective view of a hollow main shaft 301 of the third embodiment of the collapsible push-up bar 300. In an embodiment, the hollow main shaft 301 is elliptical in cross section as shown in FIGS. 3A-3D.

Figure 3C:
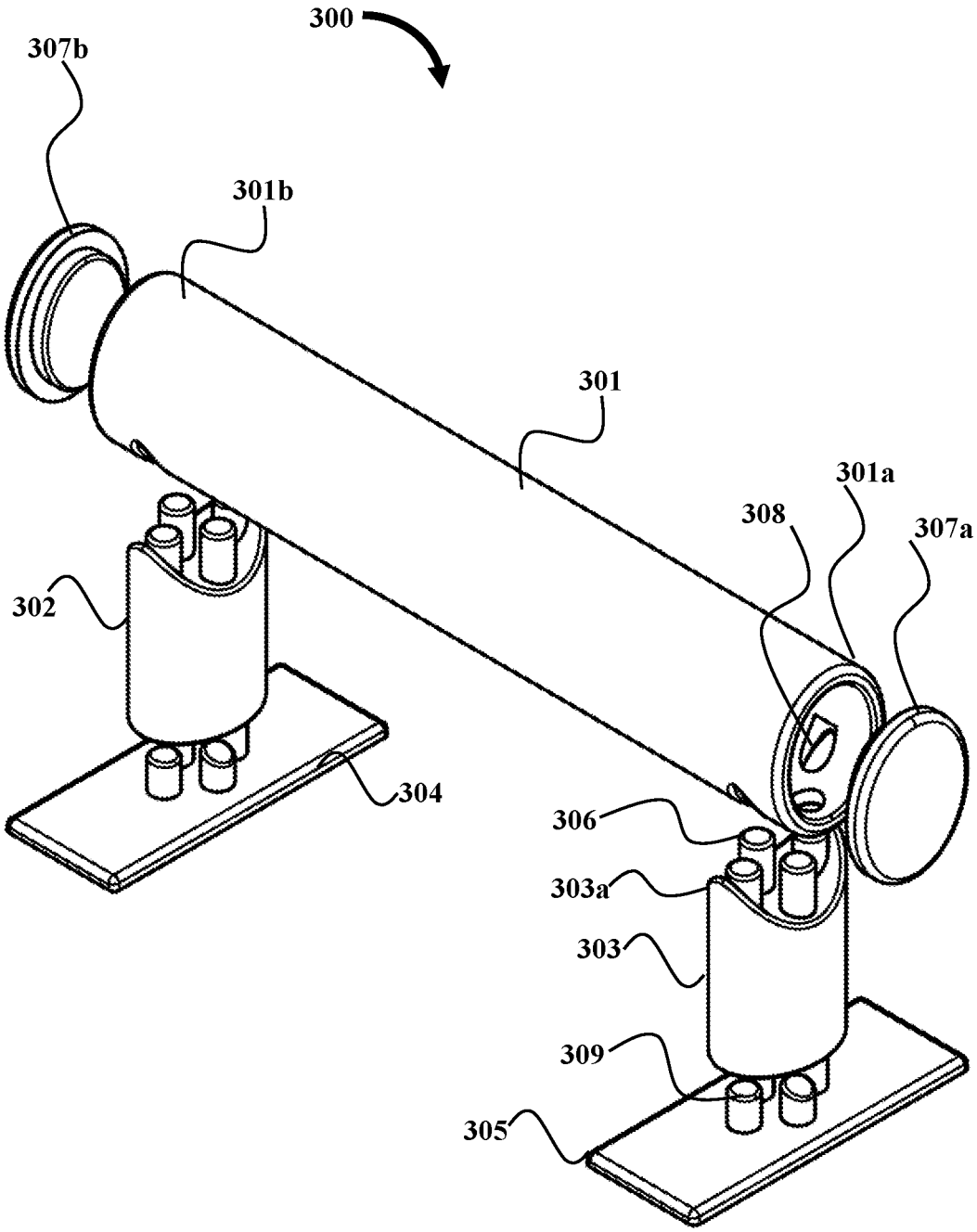
FIG. 3C exemplarily illustrates an exploded view of the third embodiment of the collapsible push-up bar.
Figure 3D:
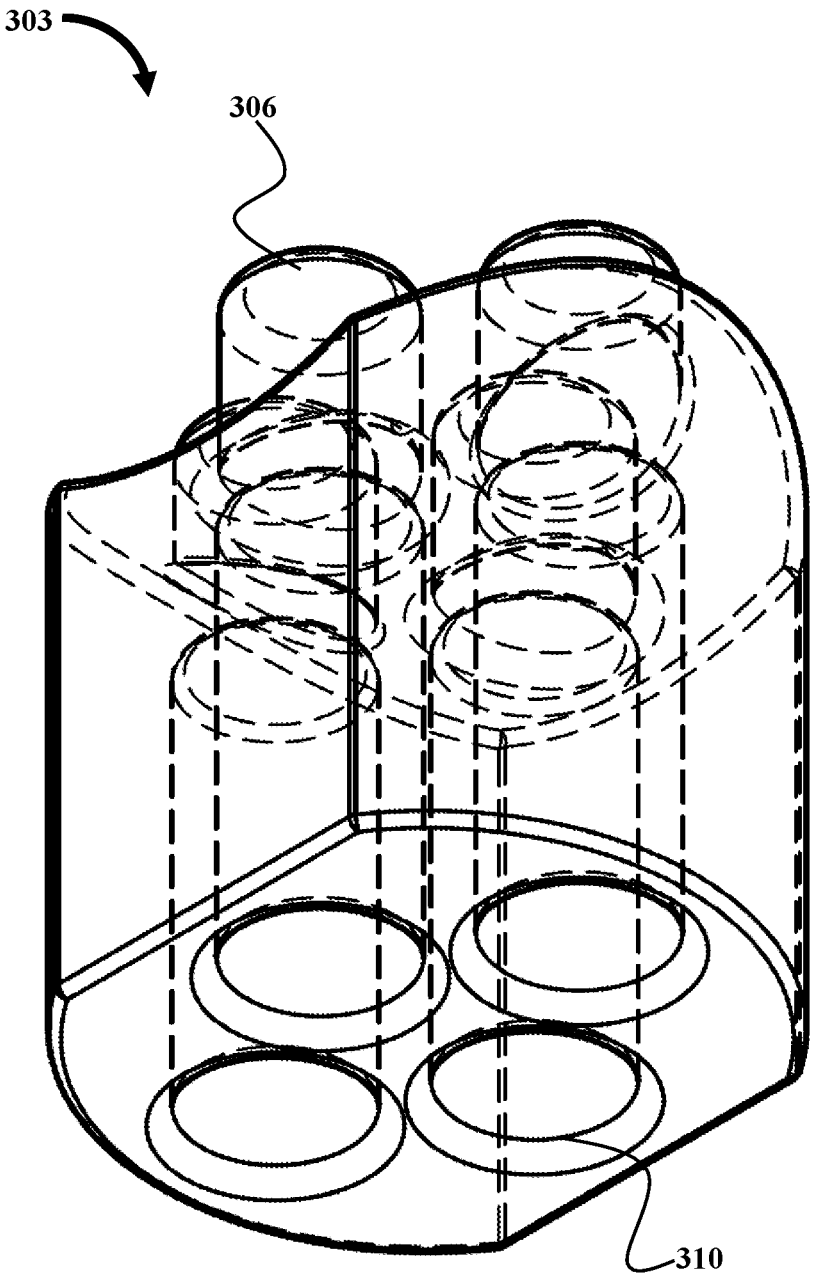
FIG. 3D exemplarily illustrates a bottom perspective view of a vertical support bar of the third embodiment of the collapsible push-up bar.
Figure 3E:
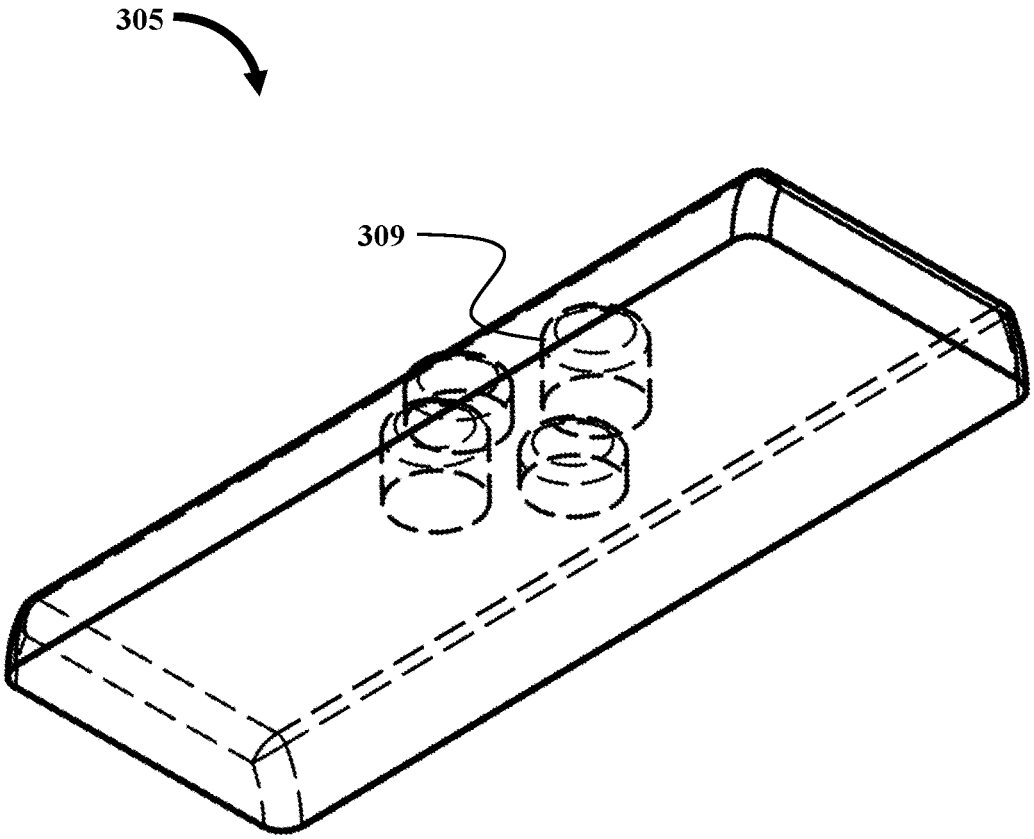
FIG. 3E exemplarily illustrates a bottom perspective view of a horizontal support bar of the third embodiment of the collapsible push-up bar.
Figure 3F:
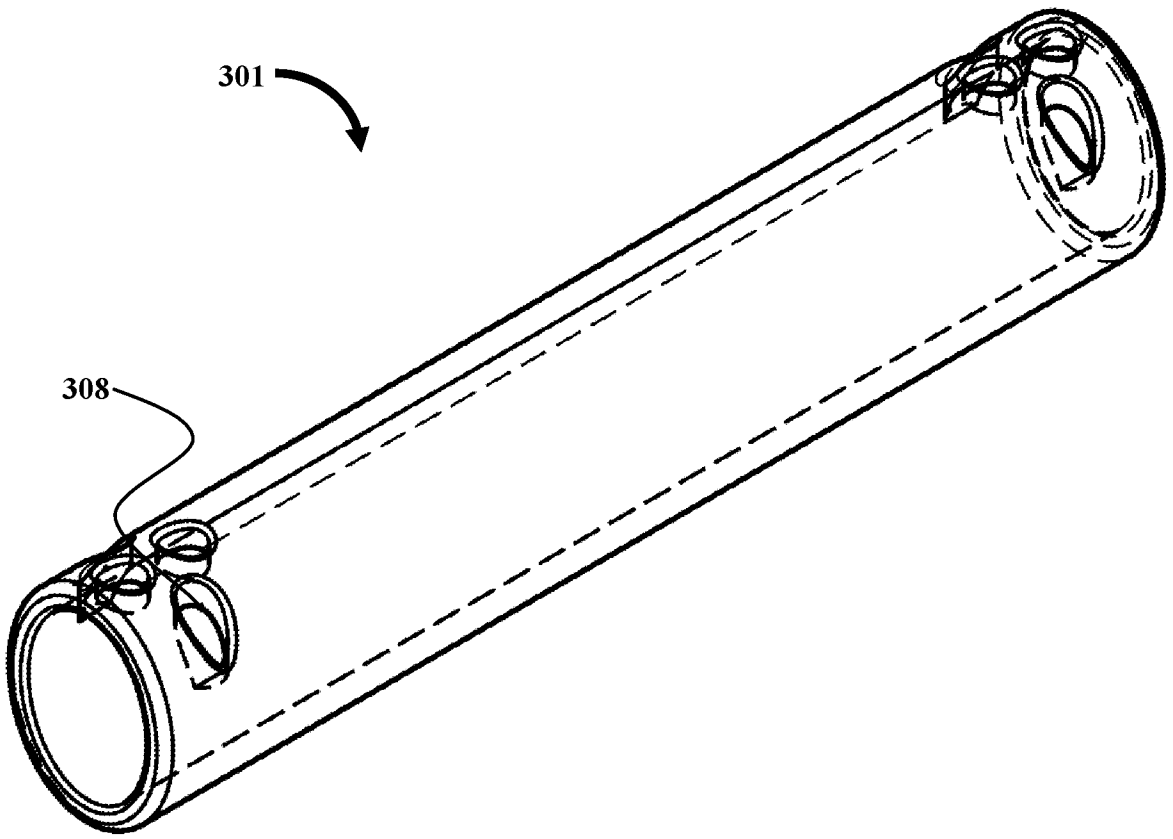
FIG. 3F exemplarily illustrates a top perspective view of a hollow main shaft of the third embodiment of the collapsible push-up bar.

In an embodiment, each engagement device 308, as illustrated in FIG. 3C, is a receptacle configured to receive a button type snap fit fastener 306 that is disposed at a proximal end 303*a* of one or more support legs 303, wherein the support leg 303 is also the vertical support bar 303. In another embodiment, as illustrated in FIG. 3C, each engagement device 308 comprises one or more snap fit receivers, for example, female receivers configured to receive and removably secure one or more support legs 303, or the vertical support bar 303, that comprise an opposing one or more male receivers. As illustrated in FIG. 3C, a set of male receivers 306 disposed on the top portion of the vertical support bar 303 are configured to be removably secured to a set of female receivers 308 or to the engagement device 308 of the hollow main shaft 301. A set of male receivers 309 disposed on the horizontal support bar 305, as illustrated in FIG. 3E, are configured to removably engage with female receivers 310 shown in FIG. 3D, positioned at the bottom of the vertical support bar 303. The area on the top portion of the vertical support bar 303 around the one or more male receivers 309 is configured to conform to the shape of the horizontal support bar 305 that contacts the top portion of the vertical support bar 303. FIG. 3E illustrates a horizontal support bar 305 that comprises the male receivers 309 and FIG. 3F illustrates the hollow main shaft 301 that comprises the female receivers 308. In another embodiment, the horizontal support bar 305 comprises one or more male receivers 309 and the vertical support bar 303 comprises one or more corresponding female receivers 308 on the top portion. The horizontal support bar 304 comprises one or more female receivers 308 and the bottom of the vertical support bar 303 comprises one or more corresponding male receivers 309. In an embodiment, the collapsible push-up bar 300 further comprises a removable first end-cap 307*a* and a removable second end-cap 307*b*, as shown in FIG. 3C. The first and second removable end-caps 307*a* and 307*b* are disposed and removably secured to the proximal and distal ends 301*a* and 301*b* of the hollow main shaft 301 after the vertical support bars 302 and 303, and the horizontal support bars 304 and 305 are inserted into the hollow main shaft 301. In an embodiment, the hollow main shaft 301 comprises an open proximal end 301*a* and a closed distal end 301*b* opposite to the open proximal end 301*a*. In this embodiment, a single end-cap 307*a* is removably disposed to open and close the open proximal end 301*a* of the hollow main shaft 301.

The cross-section of the hollow main shaft 301 is elliptical. The hollow main shaft 301 has a width of about 50 mm along its major axis and a width of about 40 mm along its minor axis. In an embodiment, the push-up bar 300 is about 75 mm to about 250 mm in height, the vertical support bars 302 and 303 are about 55 mm to about 229 mm in height, and the horizontal support bars 304 and 305 are about 40 mm to about 230 mm in length. In an embodiment, the length of the horizontal support bars 304 and 305 is shorter than the hollow main shaft 301. In another embodiment, the height of the push-up bar 300 is about 100 mm. In an embodiment, the length of the vertical support bars 302 and 303 is equal to the length of the horizontal support bars 304 and 305.

Figure 4A:
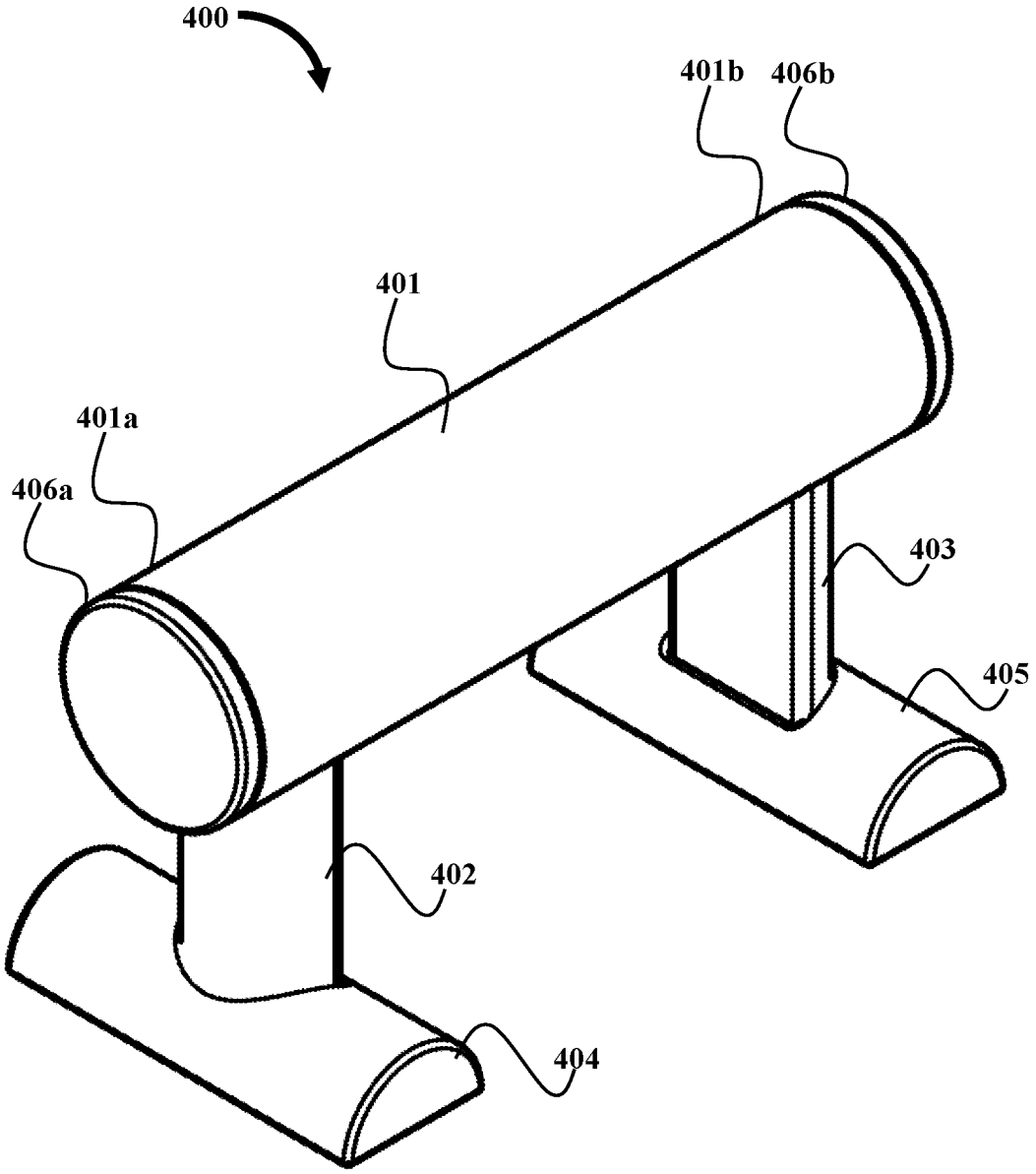
FIG. 4A exemplarily illustrates a top perspective view of a fourth embodiment of the collapsible push-up bar.

FIGS. 4A-4D exemplarily illustrate a fourth embodiment of the collapsible push-up bar 400. FIG. 4A exemplarily illustrates a top perspective view of a fourth embodiment of the collapsible push-up bar 400, FIG. 4B exemplarily illustrates a bottom perspective view of the fourth embodiment of the collapsible push-up bar 400, FIG. 4C exemplarily illustrates a top perspective view of a horizontal support bar 404 of the fourth embodiment of the collapsible push-up bar 400, and FIG. 4D exemplarily illustrates a perspective view of a hollow main shaft 401 of the fourth embodiment of the collapsible push-up bar 400. In an embodiment, the hollow main shaft 401 comprises end-caps 406*a* and 406*b* disposed and removably secured to proximal and distal ends 401*a* and 401*b*. The vertical support bars 402 and 403 are removably secured to the hollow main shaft 401.

Figure 4B:
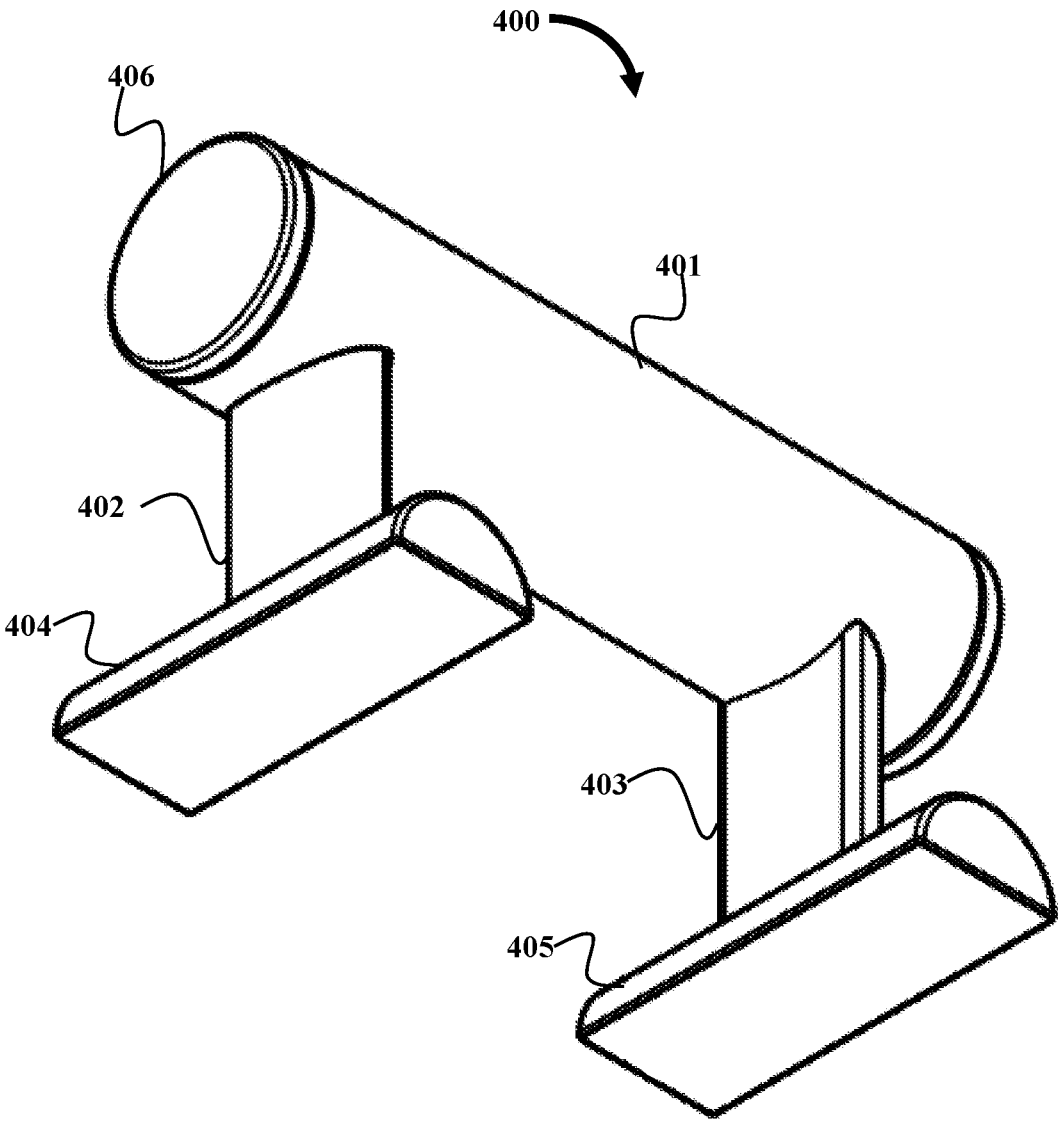
FIG. 4B exemplarily illustrates a bottom perspective view of the fourth embodiment of the collapsible push-up bar.
Figure 4C:
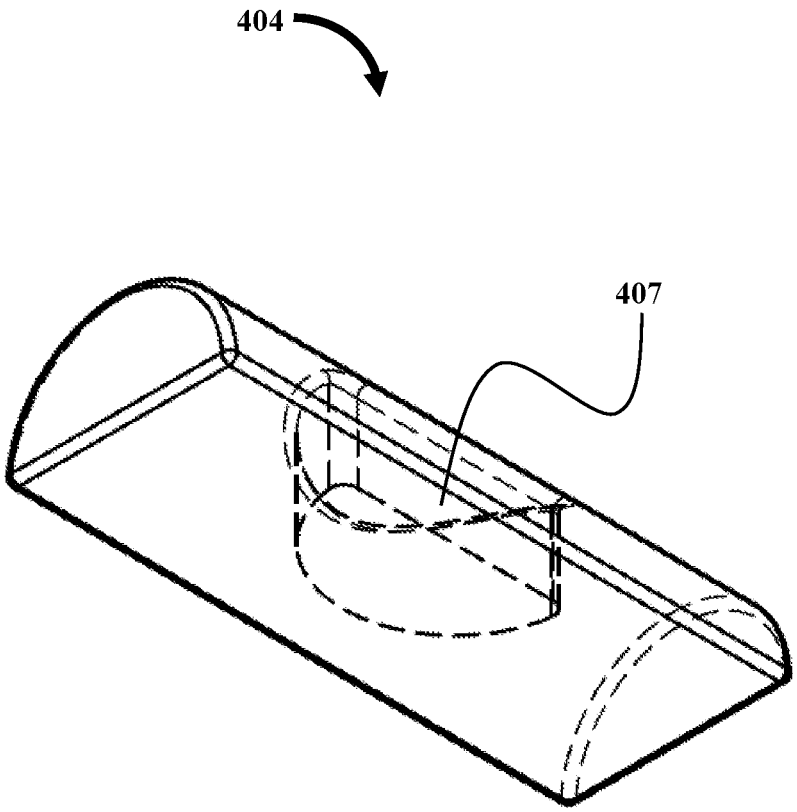
FIG. 4C exemplarily illustrates a top perspective view of a horizontal support bar of the fourth embodiment of the collapsible push-up bar.
Figure 4D:
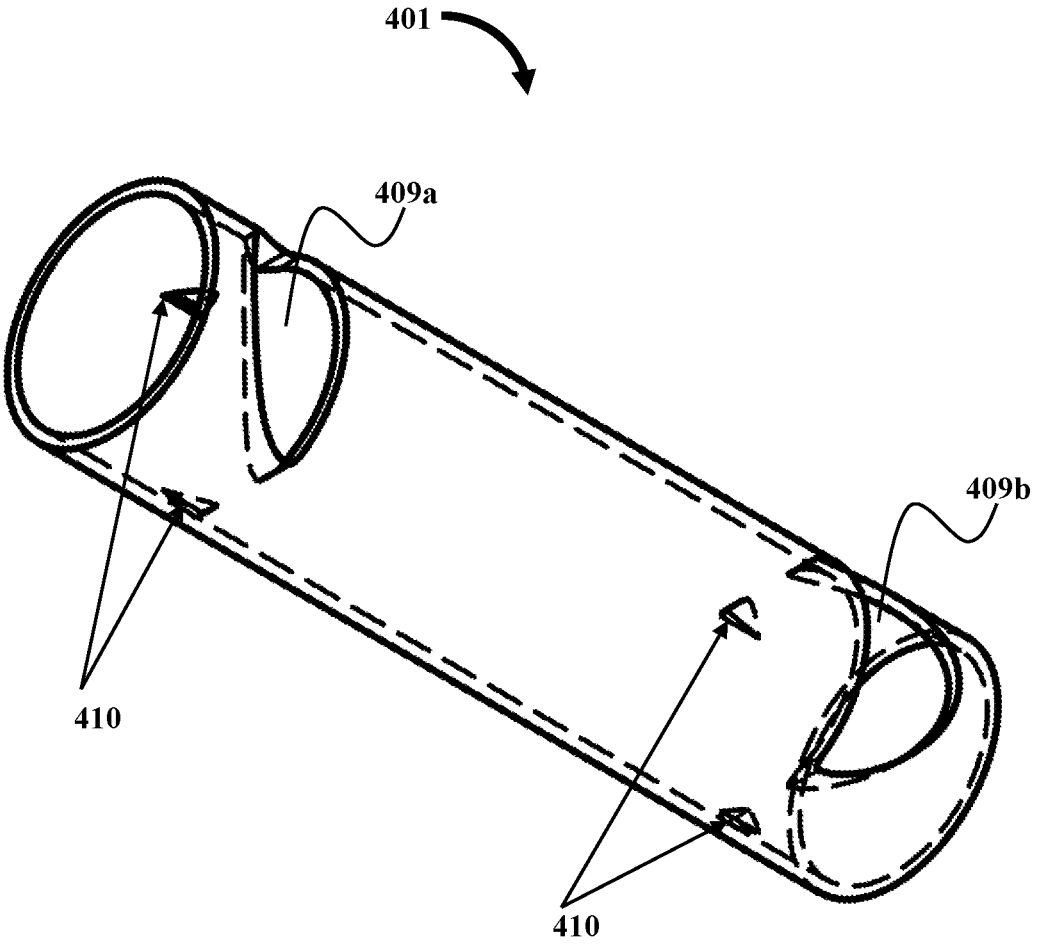
FIG. 4D exemplarily illustrates a perspective view of a hollow main shaft of the fourth embodiment of the collapsible push-up bar.

The vertical support bars 402 and 403 are removably secured to horizontal support bars 404 and 405, respectively, as shown in FIGS. 4A and 4B. As shown in FIG. 4C, the horizontal support bar 404 comprise a slot 407 configured to removably receive the bottom distal end of the vertical support bar 402. As shown in FIG. 4D, the hollow main shaft 401 comprises engagement devices 409*a* and 409*b* that are configured to removably receive the top distal ends of the vertical support bars 402 and 403. The hollow main shaft 401 comprises engagement devices 409*a* and 409*b* that are semicircular in form to receive the vertical support bars 402 and 403. In an embodiment, the hollow main shaft 401 comprises notches 410 for securing the vertical support bars 402 and 403 to the hollow main shaft 401, similar to the second embodiment illustrated in FIGS. 2A-2F.

In an embodiment, the push-up bar 400 is about 75 mm to about 250 mm in height. The vertical support bars 402 and 403 are about 55 mm to about 229 mm in height and the horizontal support bars 404 and 405 are about 55 mm to about 229 mm in length. In an embodiment, the vertical support bars 402 and 403 and the horizontal support bars 404 and 405 are of equal length. In an embodiment, the vertical support bars 402 and 403, and the horizontal support bars 404 and 405 are about half the length of the hollow main shaft 401. The horizontal support bars 404 and 405 and the vertical support bars 402 and 403 are disassembled and inserted into the hollow main shaft 401, and the end-caps 406*a* and 406*b* are thereafter removably secured to the proximal and opposing ends 401*a* and 401*b* of the hollow main shaft 401.

Figure 5A:
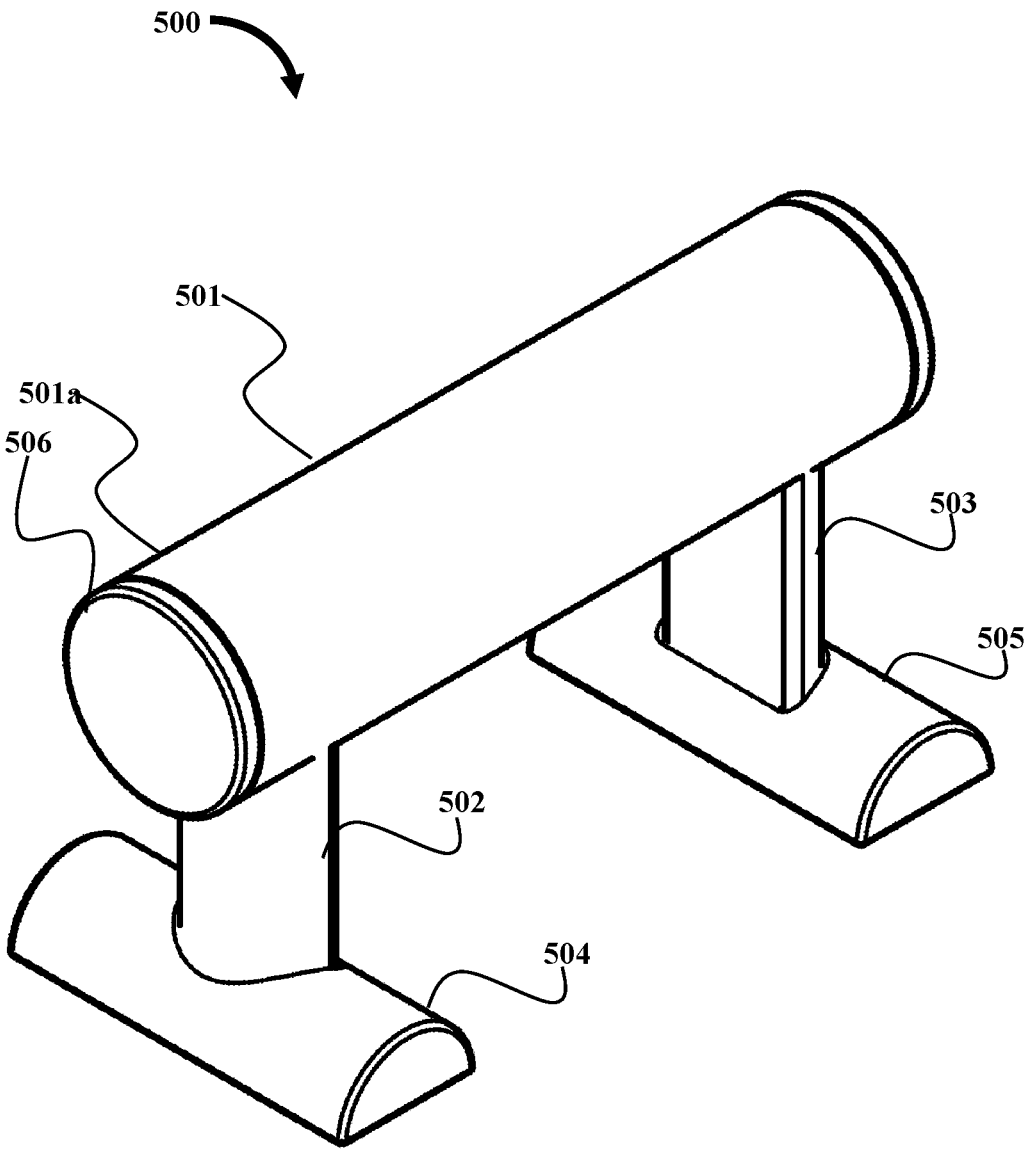
FIG. 5A exemplarily illustrates a top perspective view of a fifth embodiment of the collapsible push-up bar.
Figure 5B:
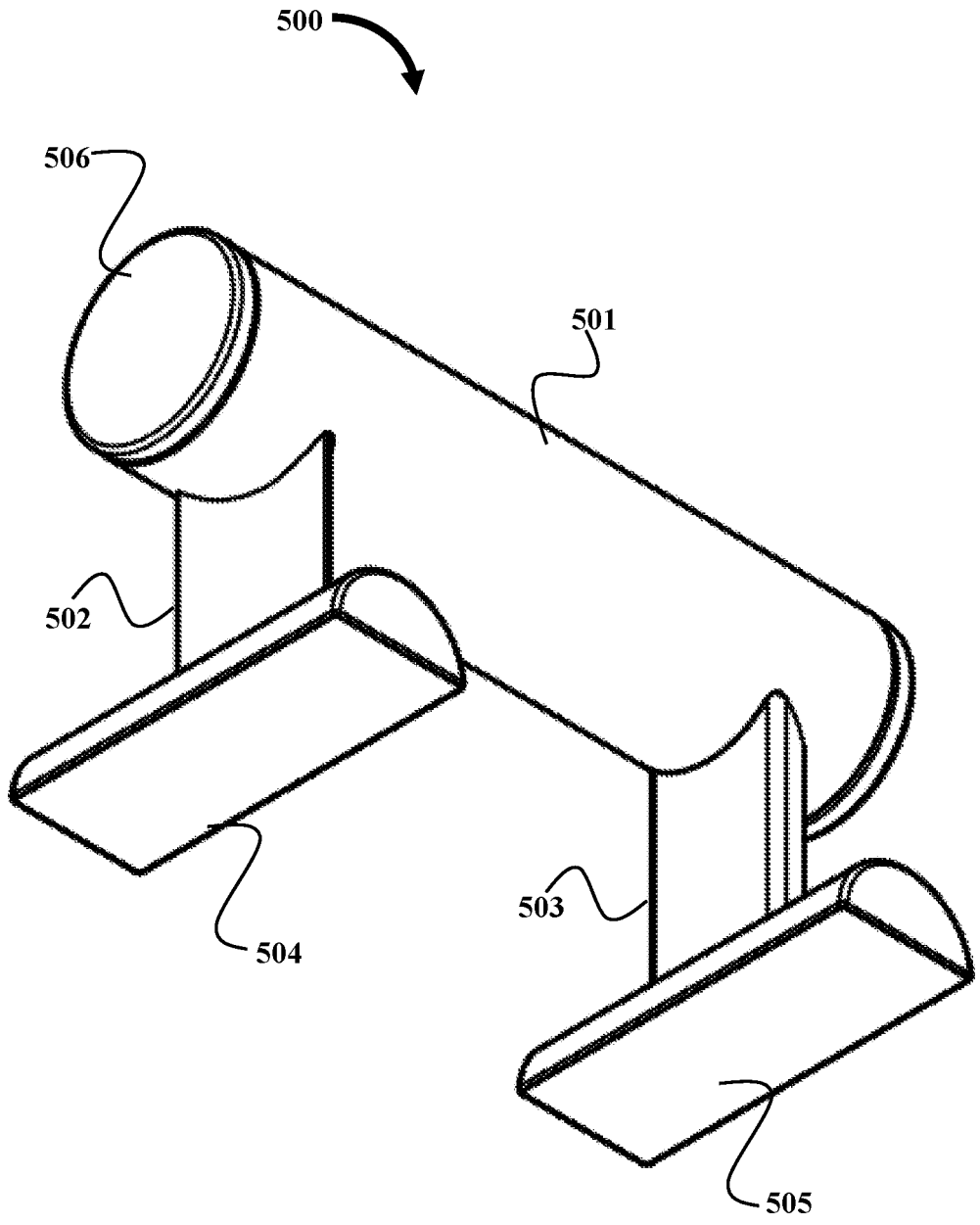
FIG. 5B exemplarily illustrates a bottom perspective view of a fifth embodiment of the collapsible push-up bar.

FIGS. 5A-5B exemplarily illustrates the fifth embodiment of the collapsible push-up bar 500. FIG. 5A exemplarily illustrates a top perspective view of a fifth embodiment of the collapsible push-up bar 500 and FIG. 5B exemplarily illustrates a bottom perspective view of a fifth embodiment of the collapsible push-up bar 500. The hollow main shaft 501 comprises an end-cap 506 disposed and removably secured to a proximal end 501*a* of the hollow main shaft 501. The hollow main shaft 501 is removably secured to the vertical support bars 502 and 503. The vertical support bars 502 and 503 are removably secured to horizontal support bars 504 and 505, respectively. In an embodiment, the vertical support bars 502 and 503 and the horizontal support bars 504 and 505 are hollow and generally semicircular in cross section. The collapsible push-up bar 500 illustrated in FIGS. 5A-5B is similar to the embodiment illustrated in FIGS. 4A-4D, except that the collapsible push-up bar 500 illustrated in FIGS. 5A-5B comprises a single end-cap 506.

Figure 6A:
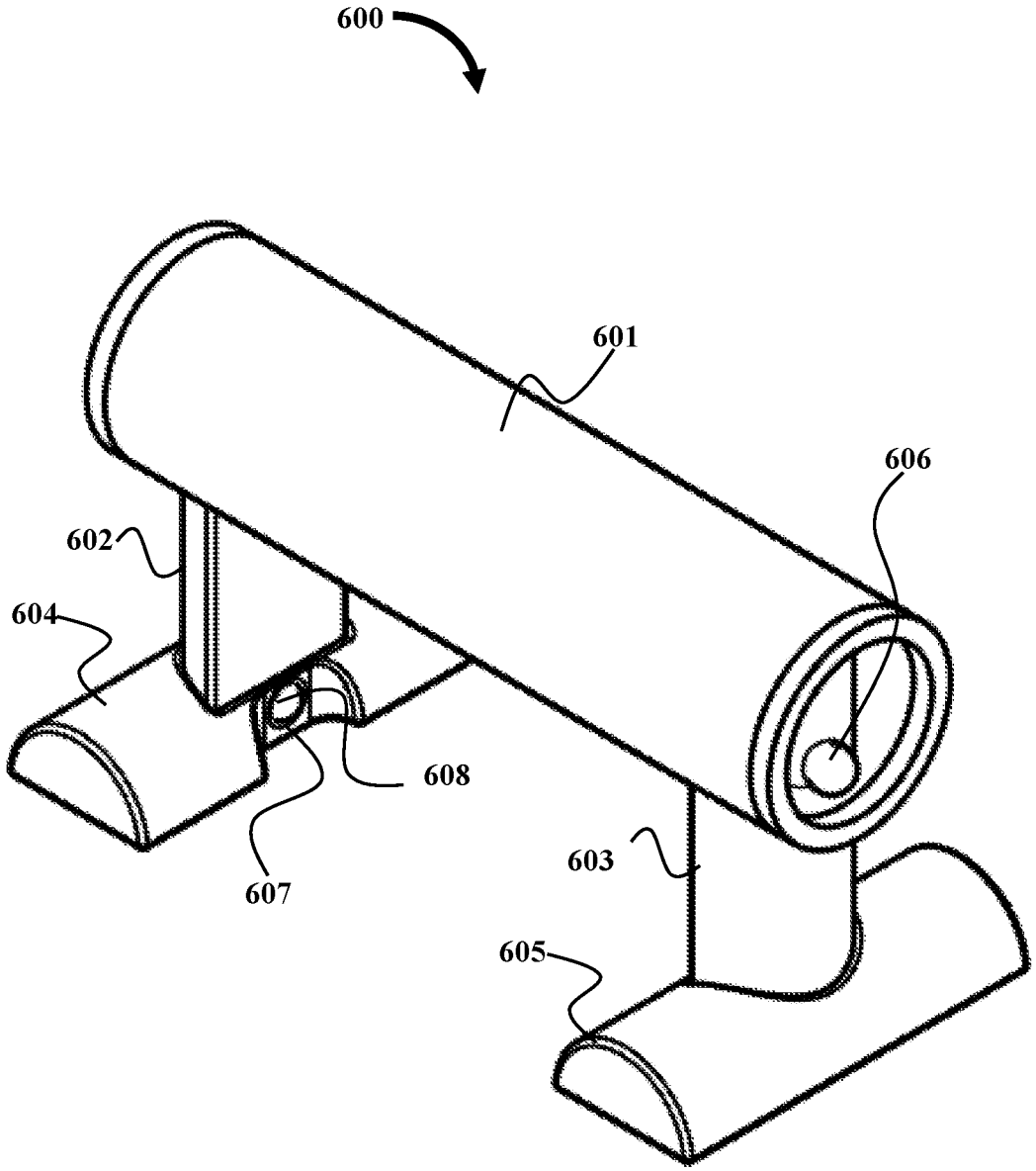
FIG. 6A exemplarily illustrates a top perspective view of a sixth embodiment of the collapsible push-up bar.
Figure 6B:
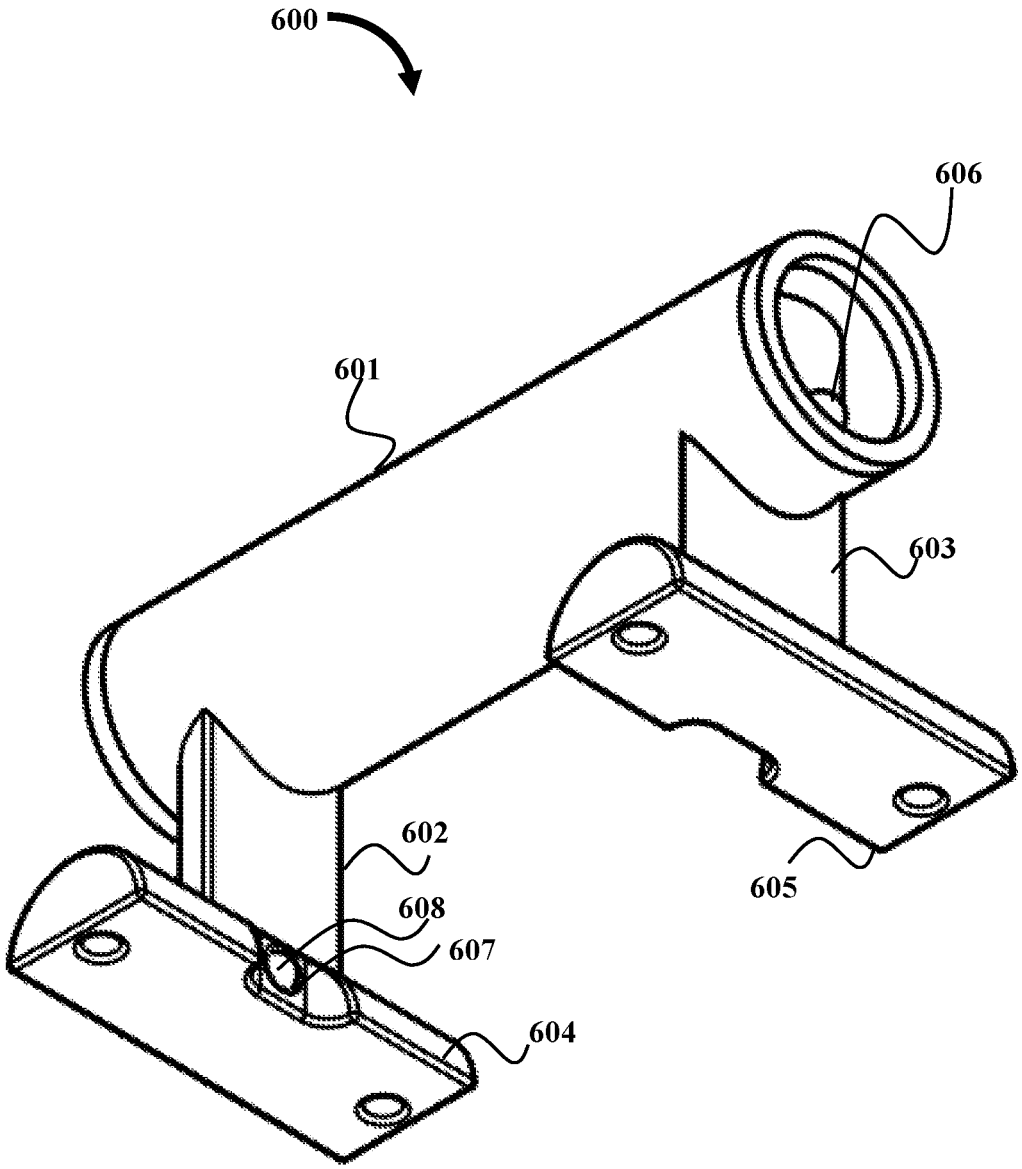
FIG. 6B exemplarily illustrates a bottom perspective view of the sixth embodiment of the collapsible push-up bar.
Figure 6C:
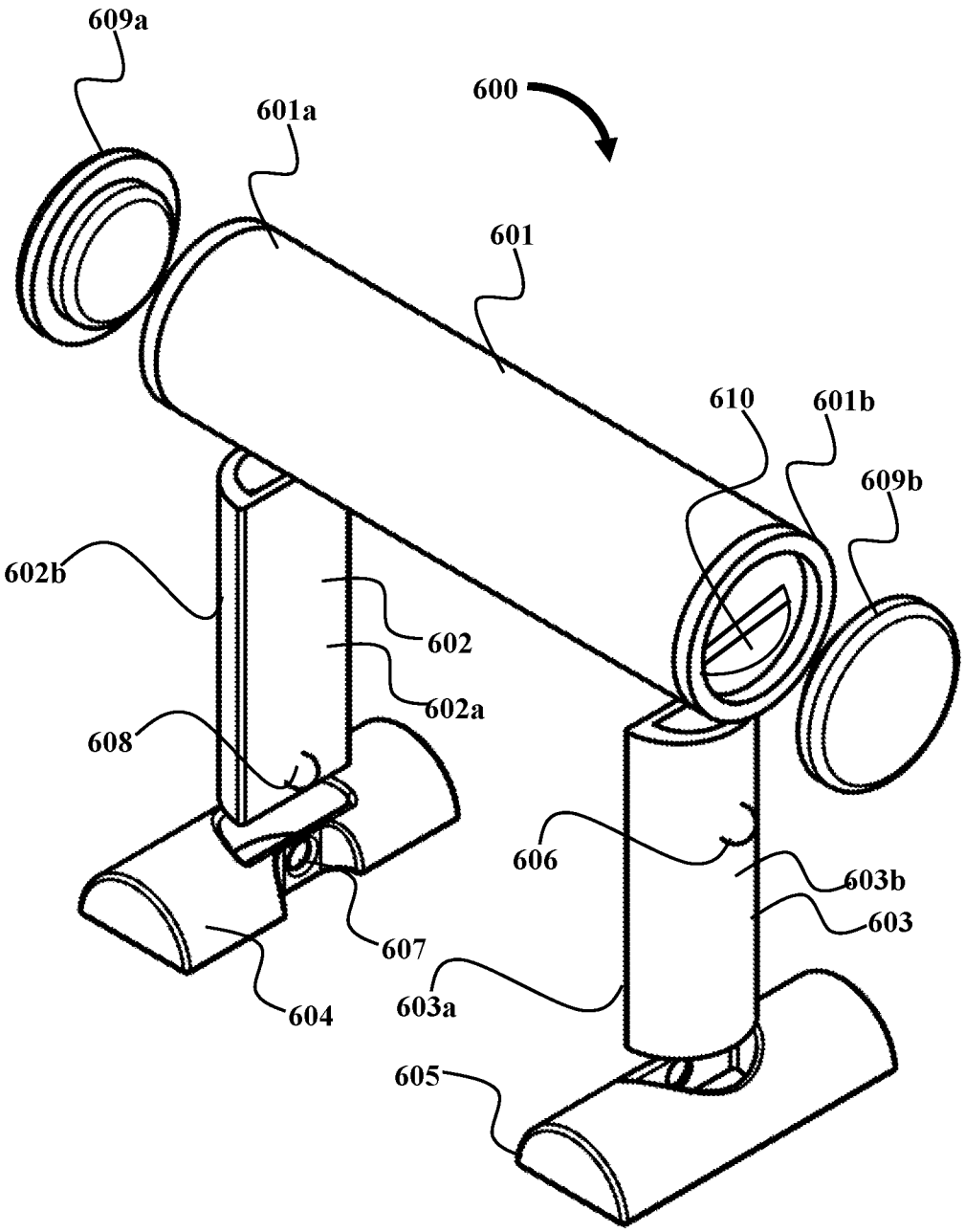
FIG. 6C exemplarily illustrates an exploded view of the sixth embodiment of the collapsible push-up bar.

FIGS. 6A-6D exemplarily illustrate the sixth embodiment of the collapsible push-up bar 600. FIG. 6A exemplarily illustrates a top perspective view of a sixth embodiment of the collapsible push-up bar 600, FIG. 6B exemplarily illustrates a bottom perspective view of the sixth embodiment of the collapsible push-up bar 600, FIG. 6C exemplarily illustrates an exploded view of the sixth embodiment of the collapsible push-up bar 600, FIG. 6D exemplarily illustrates a top perspective view of a horizontal support bar 604 of the sixth embodiment of the collapsible push-up bar 600. The hollow main shaft 601 comprises end-caps 609*a* and 609*b*, as shown in FIG. 6C, disposed and removably secured to proximal and opposing ends 601*a* and 601*b* and the hollow main shaft 601. The hollow main shaft 601 is removably secured to the vertical support bars 602 and 603 and the vertical support bars 602 and 603 are removably secured to horizontal support bars 604 and 605, respectively.

Figure 6D:
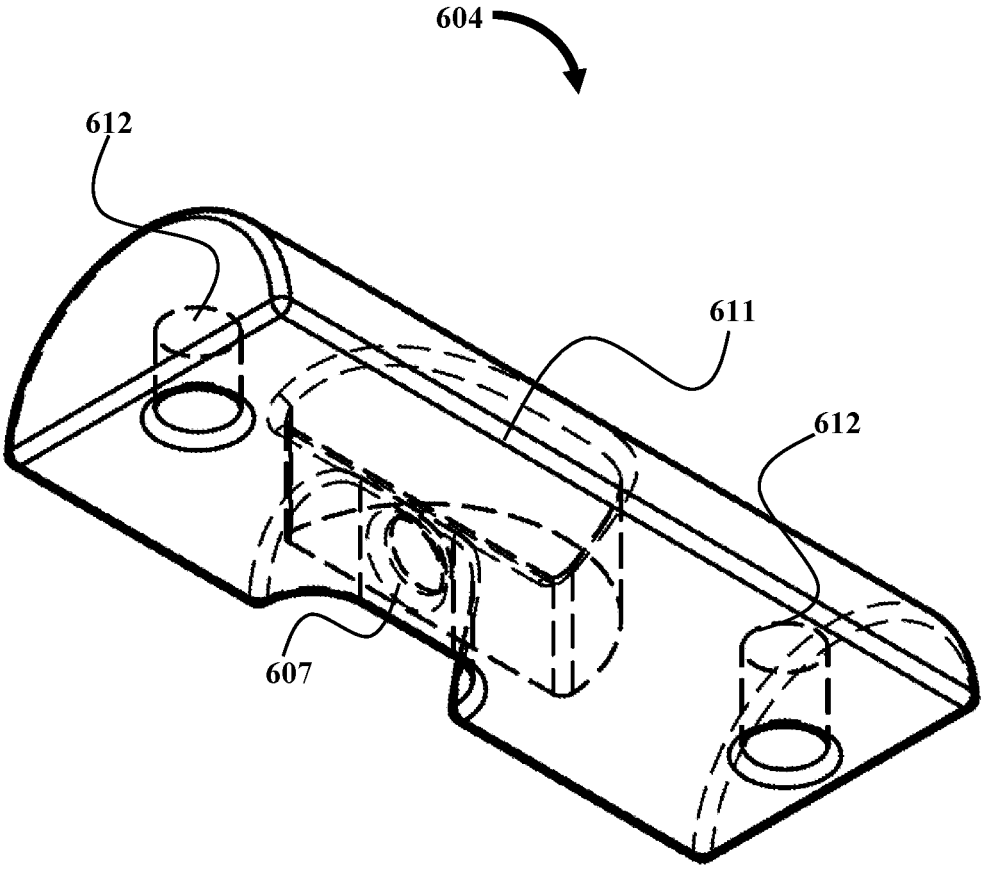
FIG. 6D exemplarily illustrates a top perspective view of a horizontal support bar of the sixth embodiment of the collapsible push-up bar.

As illustrated in FIGS. 6A and 6C, the vertical support bars 602 and 603 comprise pins 606 and 608, for example, spring loaded ball lock pins. The pin 606 positioned proximal to the top of the vertical support bar 603 is configured to snap fit to a engagement device 610 of the hollow main shaft 601, and the pin 608 positioned proximal to the bottom of the vertical support bar 602 is configured to snap fit into a hole 607 disposed on the horizontal support bar 604. As illustrated in FIGS. 6A and 6C, the vertical support bars 602 and 603 comprise a semicircular cross-section. The pin 606 is disposed on a curved side 603*b* of the vertical support bar 603, proximal to the top of the vertical support bar 603. The pin 608 is disposed on a diametrical side 602*a* of the vertical support bar 602, proximal to the bottom of the vertical support bar 602. As shown in FIG. 6D, the horizontal support bar 602 comprises a slot 611 to receive the bottom portion of the vertical support bar 608, where the pin 608 of the vertical support bar 608 snap fits into the hole 607 disposed on a wall in slot 611 of the vertical support bar 608. In an embodiment, the horizontal support bar 604 comprises one or more holes 612 as shown in FIG. 6D. The pin 608 positioned on the diametrical side 602*a* of the vertical support bar 602 is configured to be accommodated in either of the holes 612 when the diametrical side 602*a* of the vertical support bar 602 and the diametrical side of the horizontal support bar 604 are in contact with each other for insertion of the horizontal support bar 604 and the vertical support bar 602 into the hollow main shaft 601.

Figure 7A:
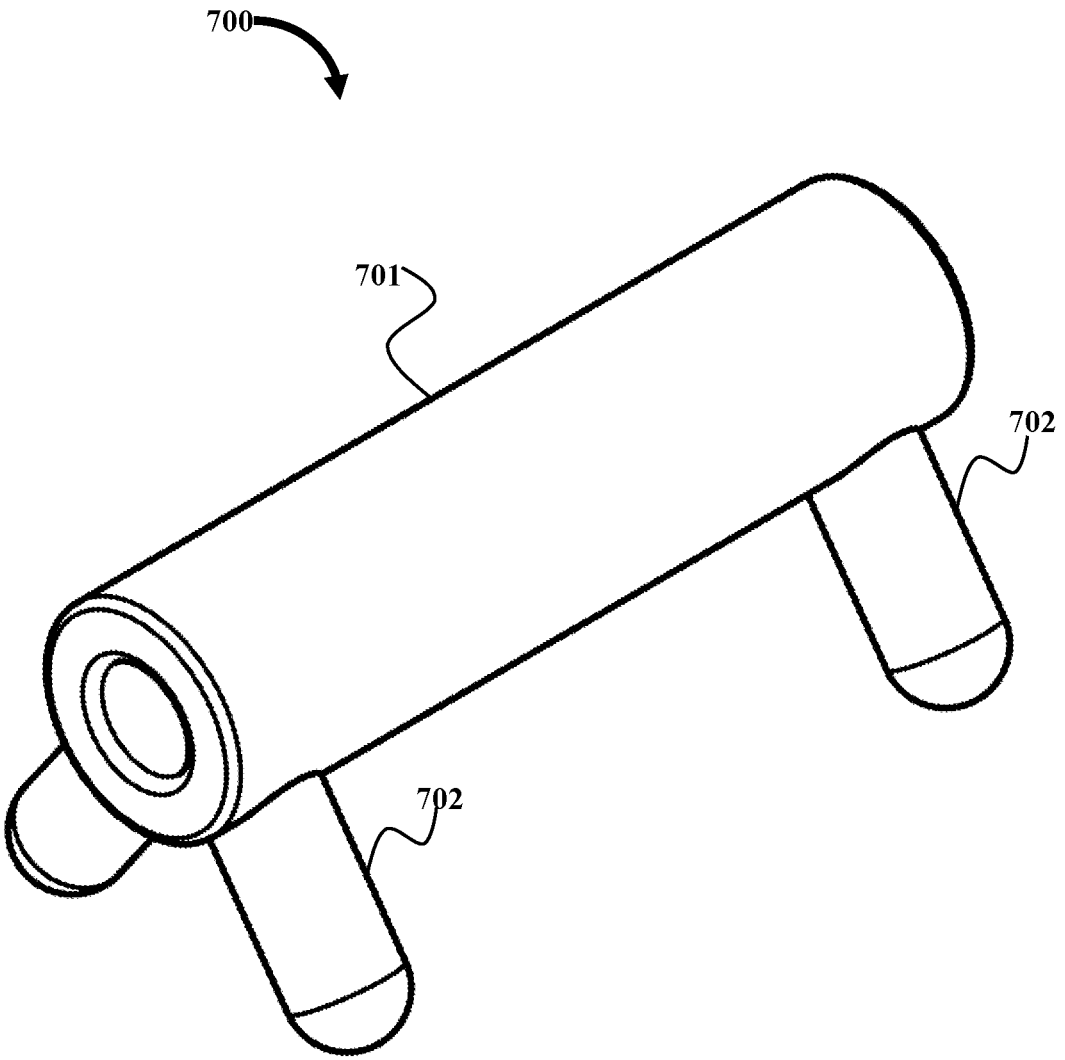
FIG. 7A exemplarily illustrates a top perspective view of a seventh embodiment of the collapsible push-up bar.
Figure 7B:
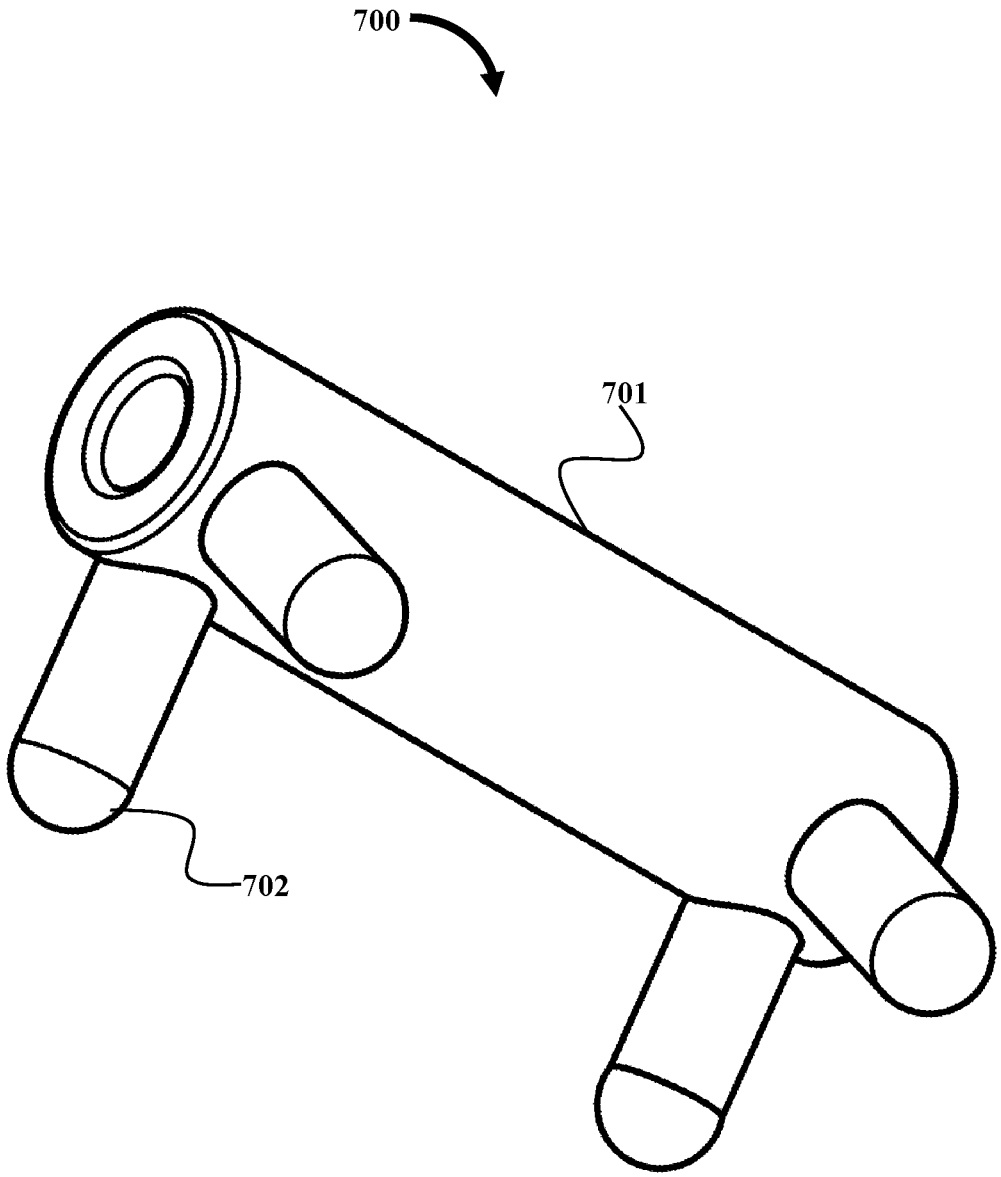
FIG. 7B exemplarily illustrates a bottom perspective view of the seventh embodiment of the collapsible push-up bar.
Figure 7C:
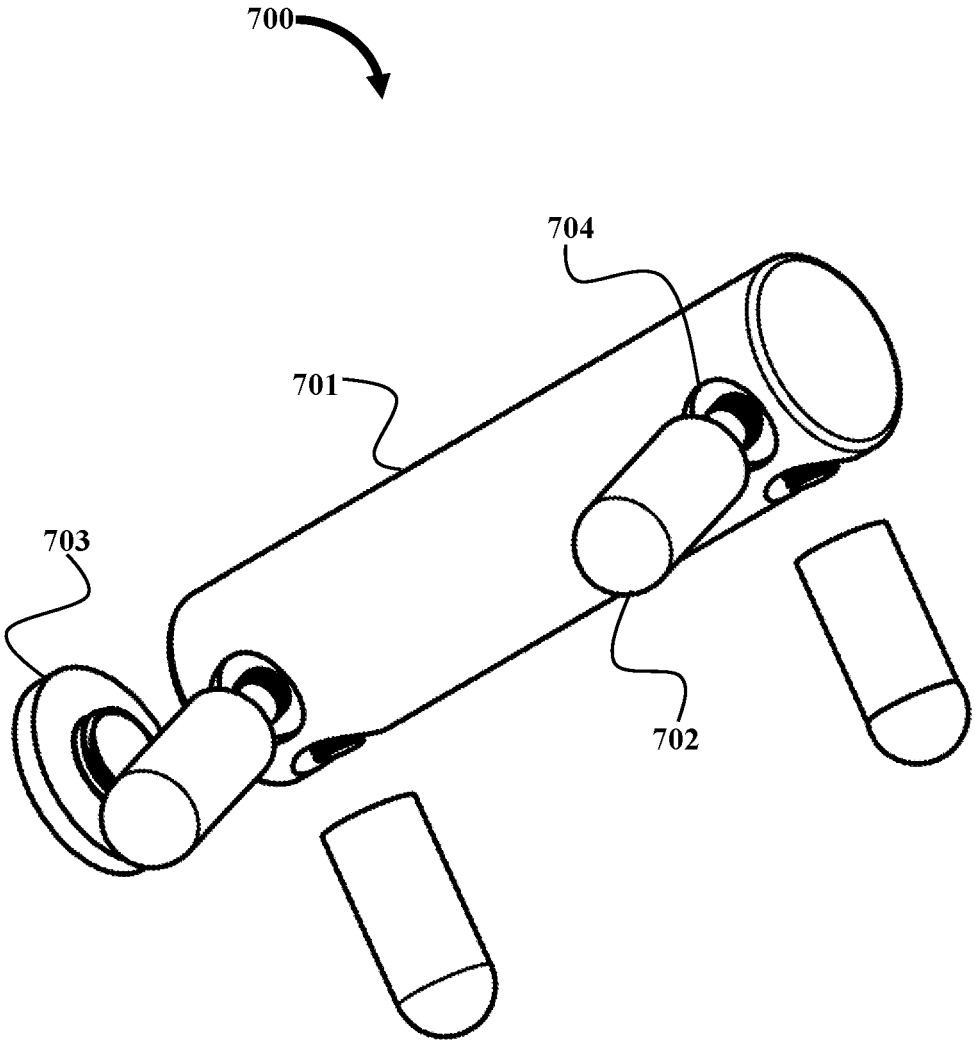
FIG. 7C exemplarily illustrates an exploded view of the seventh embodiment of the collapsible push-up bar.
Figure 7D:
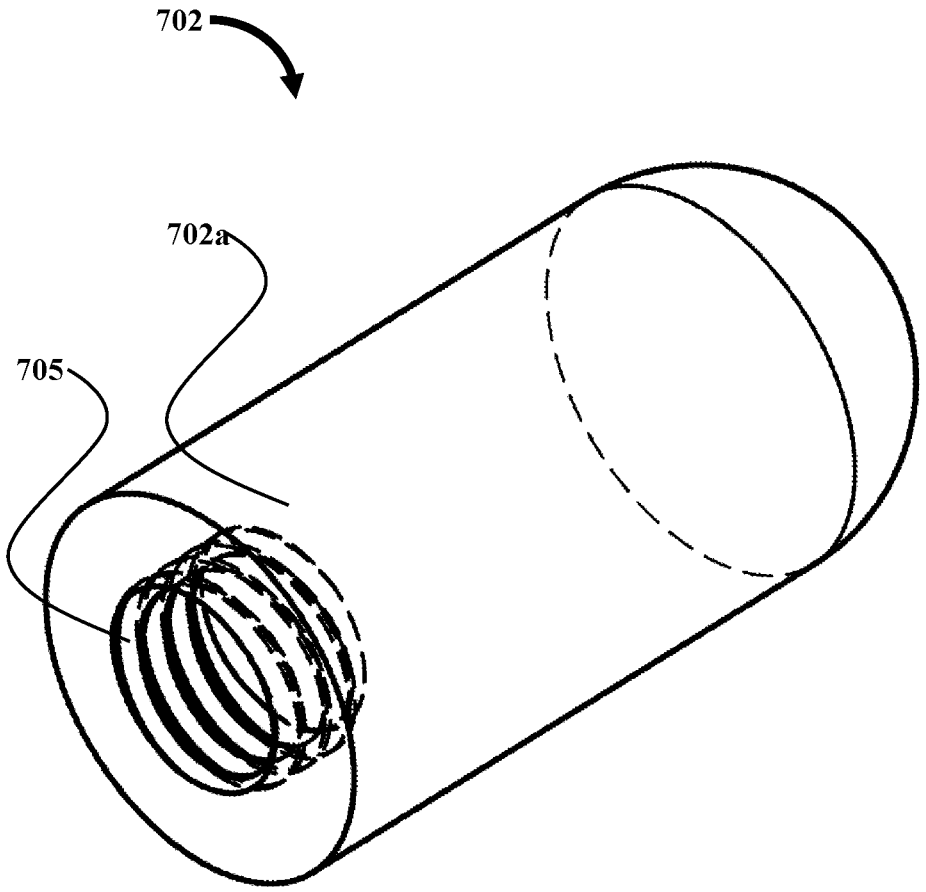
FIG. 7D exemplarily illustrates a top perspective view of a support leg of the seventh embodiment of the collapsible push-up bar.
Figure 7E:
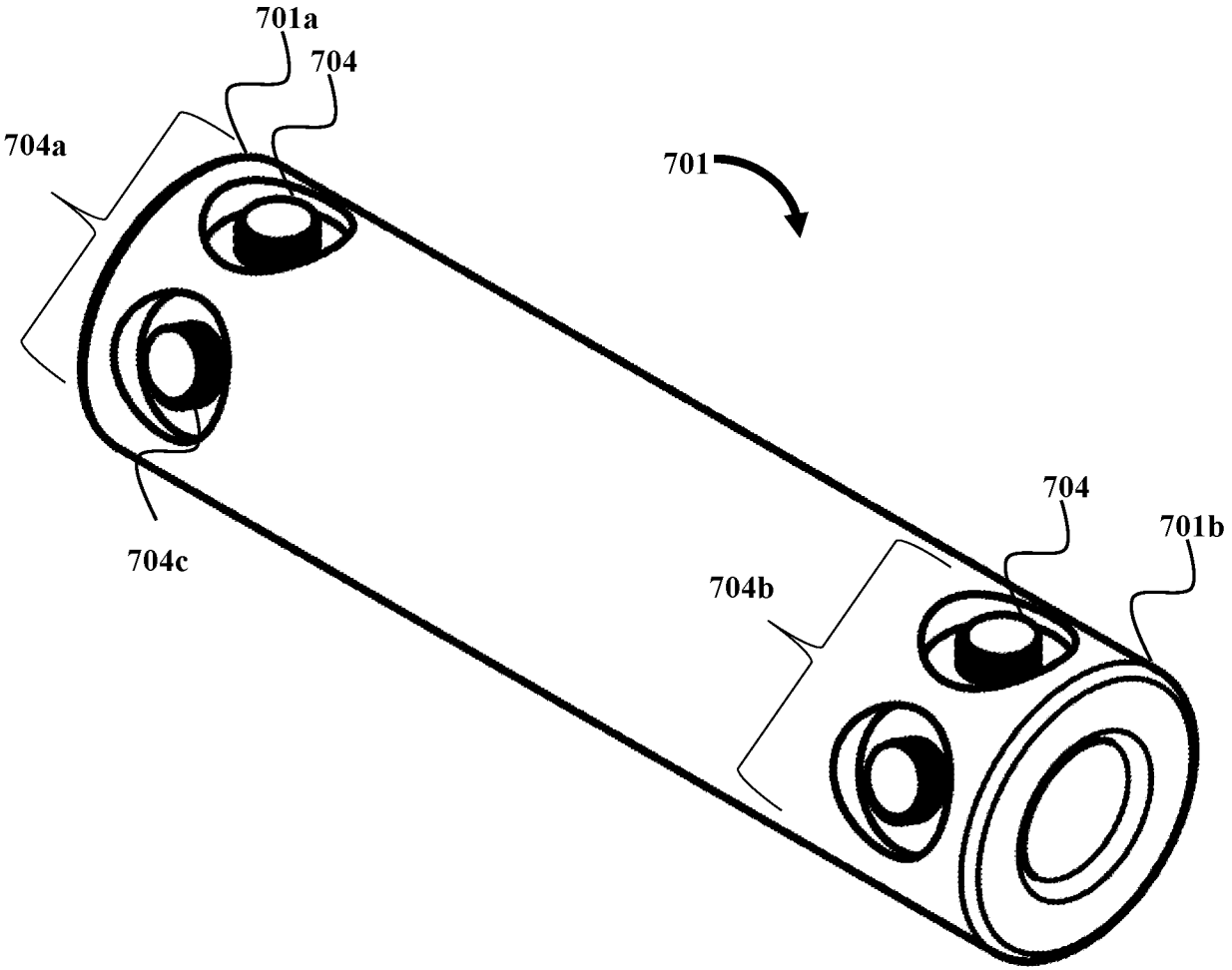
FIG. 7E exemplarily illustrates a top perspective view of a hollow main shaft of the seventh embodiment of the collapsible push-up bar.

FIGS. 7A-7E exemplarily illustrate the seventh embodiment of the collapsible push-up bar 700. FIG. 7A exemplarily illustrates a top perspective view of a seventh embodiment of the collapsible push-up bar 700, FIG. 7B exemplarily illustrates a bottom perspective view of the seventh embodiment of the collapsible push-up bar 700, FIG. 7C exemplarily illustrates an exploded view of the seventh embodiment of the collapsible push-up bar 700, FIG. 7D exemplarily illustrates a top perspective view of a support leg 702 with spherical ends defining the seventh embodiment of the collapsible push-up bar 700, and FIG. 7E exemplarily illustrates a top perspective view of a hollow main shaft 701 of the seventh embodiment of the collapsible push-up bar 700. The hollow main shaft 701 is cylindrical in cross section and comprises engagement devices 704 that are configured to receive support legs 702 as shown in FIG. 7C. The hollow main shaft 701 comprises at least four engagement devices 704 arranged in pairs. A first pair of the engagement devices 704*a* is located at a proximal end 701*a* of the hollow main shaft 701 and a second pair of engagement devices 704*b* is disposed at a distal end 701*b* of the hollow main shaft 701 as shown in FIG. 7E. One or more of the proximal and distal ends 701*a* and 701*b* of the hollow main shaft 701 comprise a removable end-cap 703. In an embodiment, the removable end-cap 703 is disposed and removably secured to the proximal end 701*a* of the hollow main shaft 701 after the support legs 702 are inserted into the hollow main shaft 701. In an embodiment, each engagement device 704 comprises a hole 706 with a threaded screw body 704*c*. Each of the support legs 702 comprise a threaded hole 705 at a proximal end 702*a* of the support leg 702 that allows the support leg 702 to be removably secured to the threaded screw body 704*c*. In an embodiment, the holes 706 in the first pair of the engagement devices 704*a* are disposed adjacent to each other and angled away from each other, as illustrated in FIG. 7E. The support legs 702, when secured, also angle away from each other. In an embodiment, the support legs 702 are aligned perpendicular to the body of hollow main shaft 701.

Figure 7F:
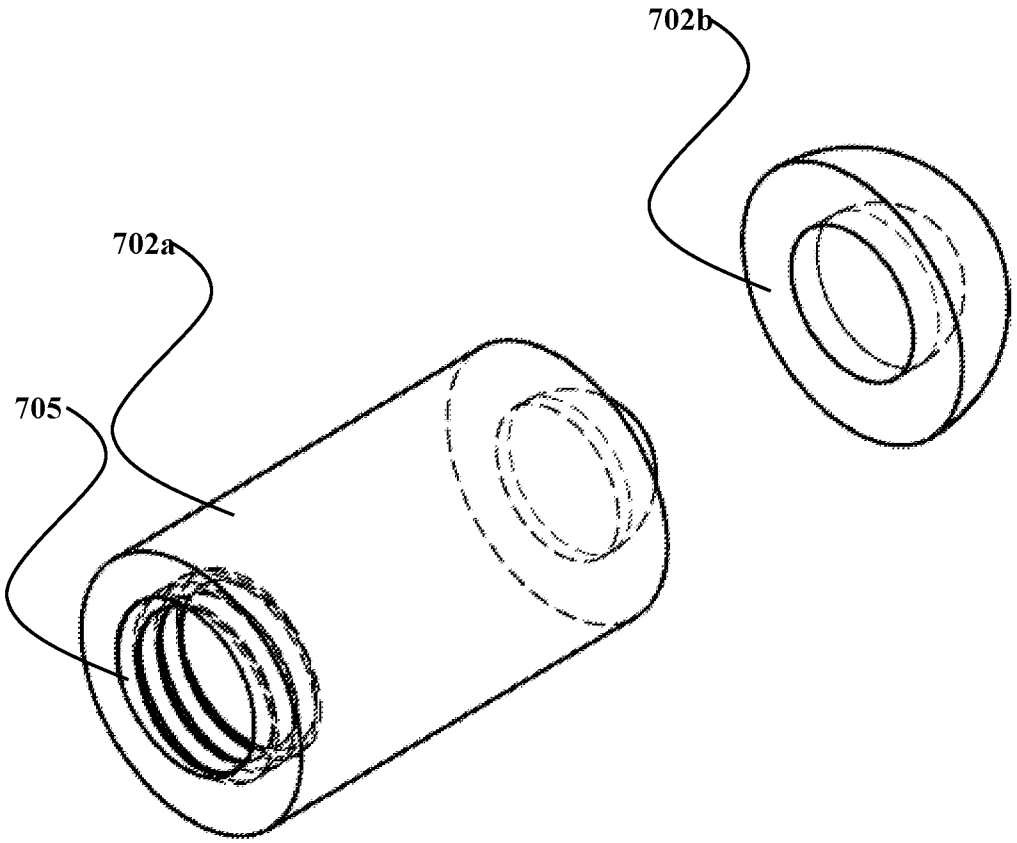
FIG. 7F exemplarily illustrates an exploded top perspective view of an alternate embodiment of the support leg of the seventh embodiment of the collapsible push-up bar.

In an embodiment, as illustrated in FIG. 7F, each of the support legs 702 comprise a hatched distal end 702*b* opposite to the proximal end 702*a*. The hatched distal end 702*b* is configured to be removably secured to the support leg 702. The hatched distal ends 702*b* contact a ground surface when the support legs 702 are removably secured to the hollow main shaft 701, and the push-up bar 700 is placed on the ground. In an embodiment, the hatched distal ends 702*b* are made of non-slip material, for example, rubber, urethane, etc. The remaining portion of the support legs 702 are made of a hard material, for example, plastic, metal, etc. In an embodiment, the hatched distal ends 702*b* are also made of a hard material and coated with a non-slip material.

The foregoing examples have been provided merely for explanation and are in no way to be construed as limiting of the collapsible push-up bar 100 disclosed herein. While the collapsible push-up bar 100 has been described with reference to various embodiments, it is understood that the words, which have been used herein, are words of description and illustration, rather than words of limitation. Furthermore, although the collapsible push-up bar 100 has been described herein with reference to particular means, materials, and embodiments, the collapsible push-up bar 100 is not intended to be limited to the particulars disclosed herein; rather, the collapsible push-up bar 100 extends to all functionally equivalent structures, methods and uses, such as are within the scope of the appended claims. While multiple embodiments are disclosed, it will be understood by those skilled in the art, having the benefit of the teachings of this specification, that the collapsible push-up bar 100 disclosed herein is capable of modifications and other embodiments may be effected and changes may be made thereto, without departing from the scope and spirit of the collapsible push-up bar 100 disclosed herein.

I claim:

1. A collapsible push-up bar comprising:

a hollow main shaft comprising one or more engagement devices disposed on a length of the hollow main shaft, wherein the hollow main shaft is configured to be held by a user during a workout;

a leg assembly, wherein the leg assembly comprises one or more support legs, and wherein the one or more support legs are configured to be removably secured to the one or more engagement devices of the hollow main shaft;

each of the support legs further comprising:

a vertical support bar, wherein one end of the vertical support bar is removably secured to the engagement device of the hollow main shaft, and an opposing end of the vertical support bar receives a horizontal support bar, and the horizontal support bar is configured to be removably secured to the opposing end of the vertical support bar along a mid-section of the horizontal support bar, wherein the horizontal support bar is configured to rest on a ground surface; and said one or more engagement devices of said hollow main shaft are semicircular in form to receive each of the vertical support bar.

2. The collapsible push-up bar of claim 1, further comprising a first end-cap and a second end cap, wherein the first and second end-caps are configured to enclose the hollow main shaft at the distal ends of the hollow main shaft after the leg assembly is inserted into the hollow main shaft.

3. The collapsible push-up bar of claim 1, wherein the hollow main shaft is elliptical in cross section.

4. The collapsible push-up bar of claim 1, wherein the vertical support bar and the horizontal support bar are hollow and are generally semicircular in cross section.

5. The collapsible push-up bar of claim 1, wherein the horizontal support bar and the vertical support bar are disassembled after the push-up bar is used, wherein the horizontal support bar after disassembly is collapsed into the vertical support bar, and wherein after the horizontal support bar is collapsed into the vertical support bar, the vertical support bar is collapsed into the hollow main shaft for compact storage of the push-up bar.

6. The collapsible push-up bar of claim 1, wherein the horizontal support bars is hollow and is generally semicircular in cross section.

7. The collapsible push-up bar of claim 1, wherein the vertical support bar is hollow and is generally semicircular in cross section.

8. The collapsible push-up bar of claim 1, wherein the horizontal support bar and the vertical support bar are disassembled after the push-up bar is used, wherein the vertical support bar after disassembly is collapsed into the horizontal support bar, and wherein after the vertical support bar is collapsed into the horizontal support bar, the horizontal support bar is collapsed into the hollow main shaft for compact storage of the push-up bar.

* * * * *